US011052297B2

(12) United States Patent
Hammons

(10) Patent No.: US 11,052,297 B2
(45) Date of Patent: Jul. 6, 2021

(54) SPORTS PRACTICE APPARATUS WITH TUNNELING

(71) Applicant: Matthew Aaron Hammons, Scottsdale, AZ (US)

(72) Inventor: Matthew Aaron Hammons, Scottsdale, AZ (US)

( * ) Notice: Subject to any disclaimer, the term of this patent is extended or adjusted under 35 U.S.C. 154(b) by 104 days.

(21) Appl. No.: 15/783,904

(22) Filed: Oct. 13, 2017

(65) Prior Publication Data

US 2018/0104559 A1 Apr. 19, 2018

Related U.S. Application Data

(60) Provisional application No. 62/408,717, filed on Oct. 15, 2016.

(51) Int. Cl.

| | |
|---|---|
| ***A63B 69/00*** | (2006.01) |
| ***A63B 69/36*** | (2006.01) |
| ***A63B 71/02*** | (2006.01) |
| ***A63B 63/00*** | (2006.01) |
| *A63B 102/14* | (2015.01) |

(52) U.S. Cl.

CPC ..... *A63B 69/00* (2013.01); *A63B 63/004* (2013.01); *A63B 69/002* (2013.01); *A63B 69/0002* (2013.01); *A63B 69/36* (2013.01); *A63B 71/022* (2013.01); *A63B 2069/0006* (2013.01); *A63B 2102/14* (2015.10); *A63B 2209/00* (2013.01); *A63B 2225/09* (2013.01); *A63B 2243/007* (2013.01)

(58) Field of Classification Search

CPC ..... A63B 69/00; A63B 63/004; A63B 71/022; A63B 69/002; A63B 69/36; A63B 69/0002; A63B 2102/14; A63B 2069/0006; A63B 2225/09; A63B 2209/00; A63B 2243/007

USPC ..... 473/166, 164, 172, 190, 195, 197, 421, 473/422, 432, 451–456, 468

See application file for complete search history.

(56) References Cited

U.S. PATENT DOCUMENTS

| | | | | | |
|---|---|---|---|---|---|
| 1,218,390 | A * | 3/1917 | Gates | A63B 71/022 | 273/396 |
| 2,043,273 | A * | 6/1936 | Watson | A63B 63/00 | 473/190 |
| 5,018,731 | A * | 5/1991 | Doyle | A63B 63/00 | 473/164 |
| 5,492,319 | A * | 2/1996 | Lee | A63B 69/3623 | 473/166 |
| 5,655,766 | A * | 8/1997 | Klebe, Jr. | A63B 71/022 | 473/197 |
| 5,823,885 | A * | 10/1998 | Stempfer | A63B 71/022 | 473/197 |

(Continued)

*Primary Examiner* — Nini F Legesse

(74) *Attorney, Agent, or Firm* — Garlick & Markison; Timothy W. Markison

(57) ABSTRACT

A sports practice apparatus includes one or more target areas, one or more tunneling sections, and mounting apparatus. A first tunneling section is operably associated with a first target area. The first tunneling section has a receiving end and a target end and narrows from the receiving end towards the target end. The narrowing of the first tunneling section follows a trajectory that conforms to desired trajectory of a sports ball set into motion during practice. The first tunneling section is constructed of a material that prevents the sports ball from existing the first tunneling section other than at the target end.

18 Claims, 27 Drawing Sheets

(56) References Cited

U.S. PATENT DOCUMENTS

| | | | | |
|---|---|---|---|---|
| 6,485,373 | B1 * | 11/2002 | Stephens | A63B 63/00 473/162 |
| 8,668,603 | B2 * | 3/2014 | Hammons | A63B 69/0002 473/421 |
| 2009/0209372 | A1 * | 8/2009 | Rigoli | A63B 71/022 473/435 |
| 2009/0286631 | A1 * | 11/2009 | Hammons | A63B 69/0002 473/455 |

* cited by examiner sport practice apparatus 700
front view sport practice apparatus 700
side view sport practice apparatus 700
top view side view side view side view side view sport practice apparatus 700-1
front view sport practice apparatus 700-1
side view sport practice apparatus 700-1
top view side view side view side view front view sport practice apparatus 700-2
top view sport practice apparatus 700-2
front view sport practice apparatus 700-2
top view sport practice apparatus 700-2
front view sport practice apparatus 700-2
top view sport practice apparatus 700-2
front view sport practice apparatus 700-4
front view sport practice apparatus 700-4
front view

SPORTS PRACTICE APPARATUS WITH TUNNELING

CROSS REFERENCE TO RELATED PATENTS

The present U.S. Utility Patent Application claims priority pursuant to 35 U.S.C. § 119(e) to U.S. Provisional Application No. 62/408,717, entitled "Pitching Tunnel", filed Apr. 15, 2016, which is hereby incorporated herein by reference in its entirety and made part of the present U.S. Utility Patent Application for all purposes.

STATEMENT REGARDING FEDERALLY SPONSORED RESEARCH OR DEVELOPMENT—NOT APPLICABLE

INCORPORATION-BY-REFERENCE OF MATERIAL SUBMITTED ON A COMPACT DISC—NOT APPLICABLE

BACKGROUND OF THE INVENTION

Technical Field of the Invention

This invention relates generally to sporting equipment and more particularly to sports practice apparatus.

Description of Related Art

U.S. Pat. No. 8,668,603 entitled "Lightweight Tunnel for Baseball Pitching Practice" describes a pitching tunnel apparatus made of flexible netting that a user can conveniently transport in a folded configuration to a chosen practice site for erection in a desired pitching-tunnel configuration. After unfolding the body of netting at the chosen practice site, the user secures the netting to nearby objects (e.g., four spaced-apart poles) so that the pitching tunnel extends in the desired pitching-tunnel configuration (i.e., its operative configuration), from an open proximal end portion of the pitching tunnel to a closed distal end portion. To practice pitching, a pitcher stands in front of the open proximal end portion (i.e., the pitcher end) and, from that position, pitches baseballs through the tunnel toward a target area within the distal end portion (i.e., the target end). As pitching practice continues that way, the body of netting confines the baseballs so that the pitcher can retrieve them at the target end.

BRIEF DESCRIPTION OF THE SEVERAL VIEWS OF THE DRAWING(S)

Figure 8A:
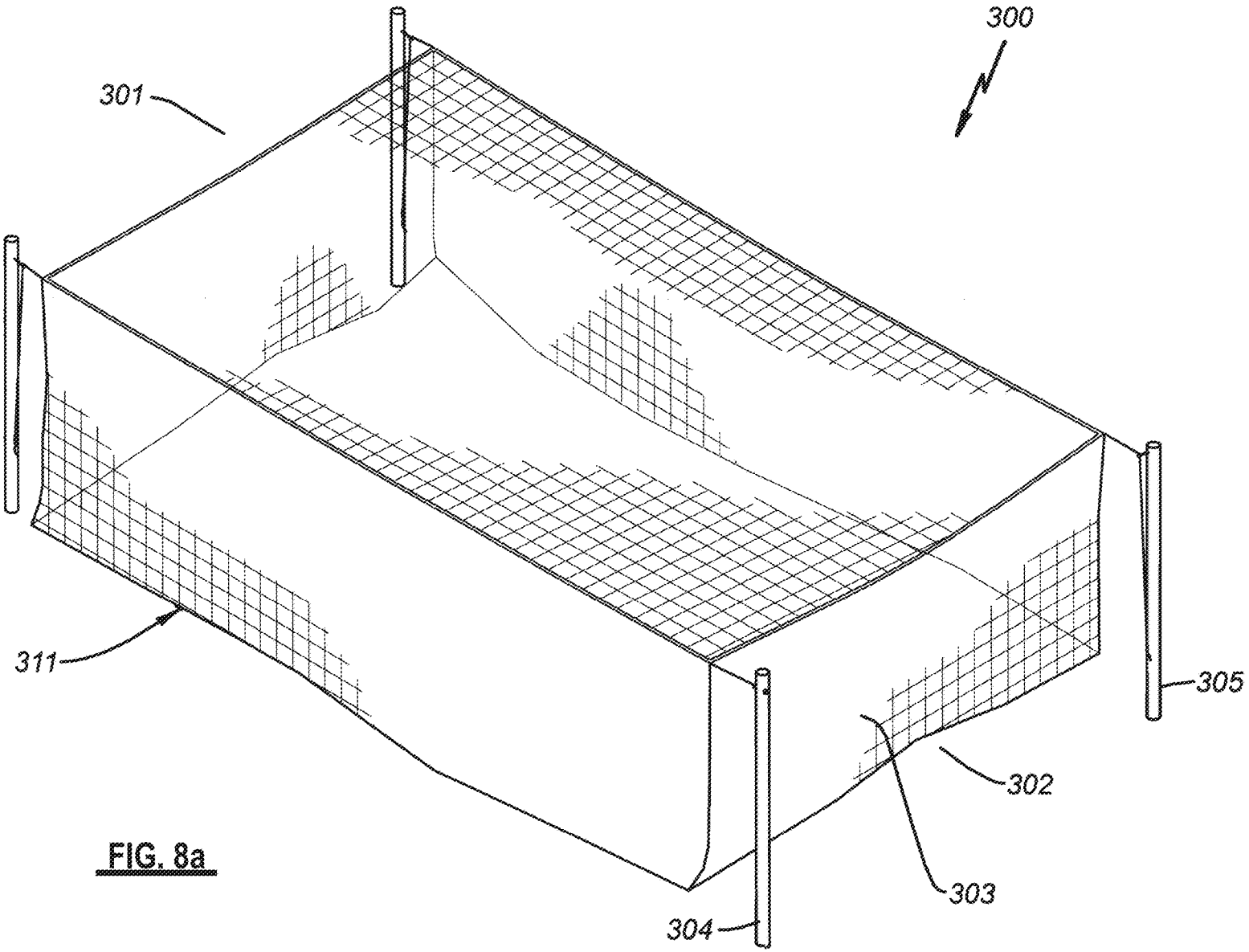
Figure 8B:
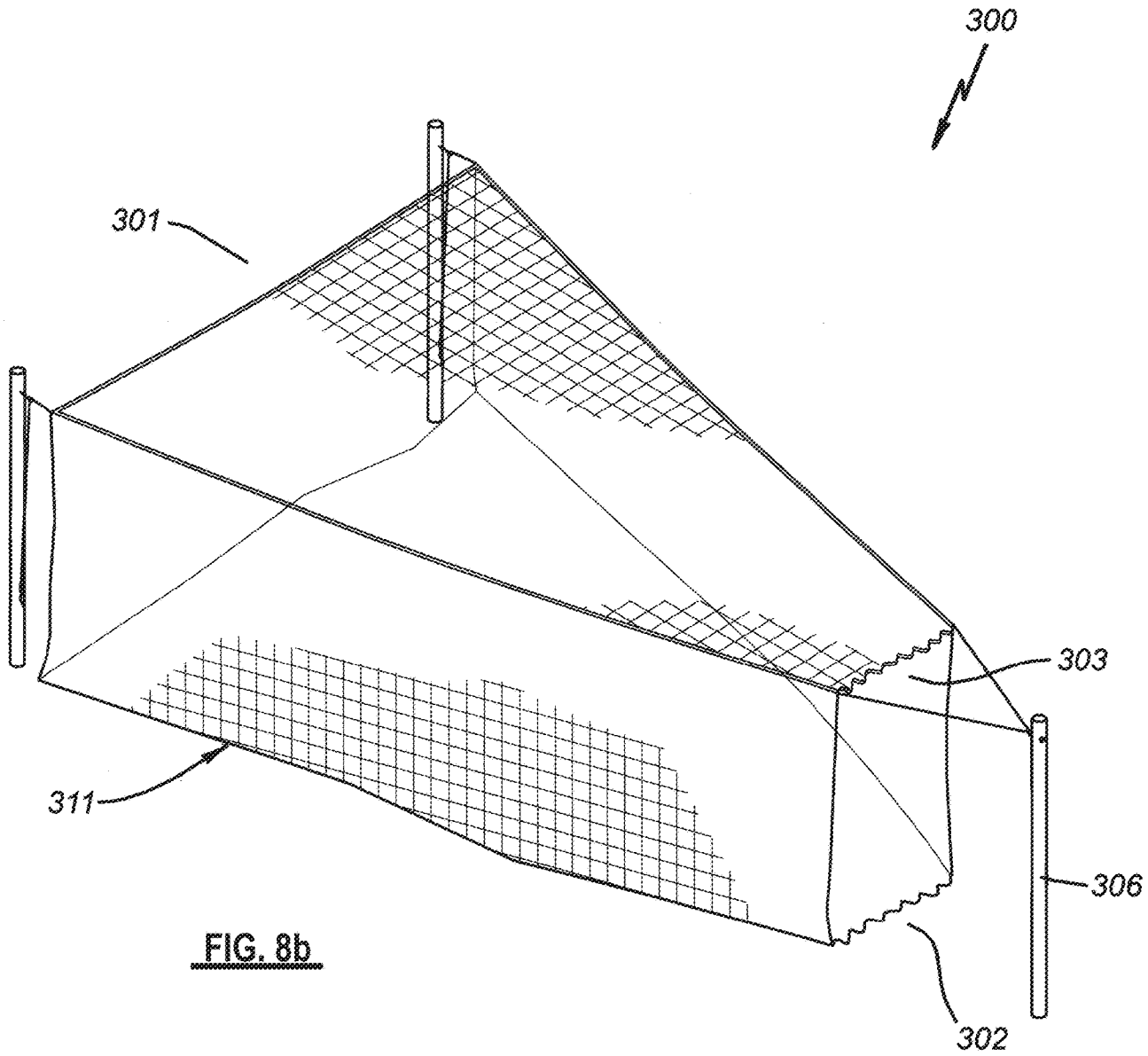
Figure 9A:
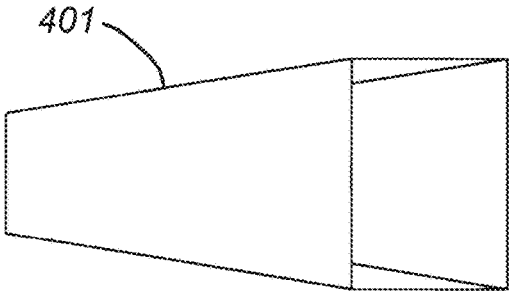
Figure 9B:
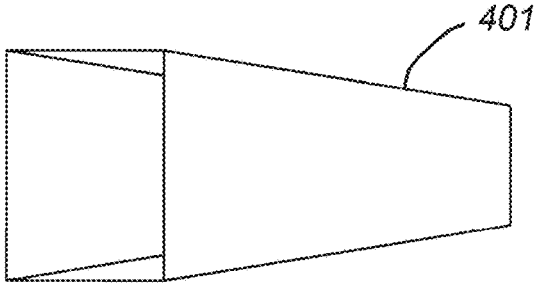
Figure 10A:
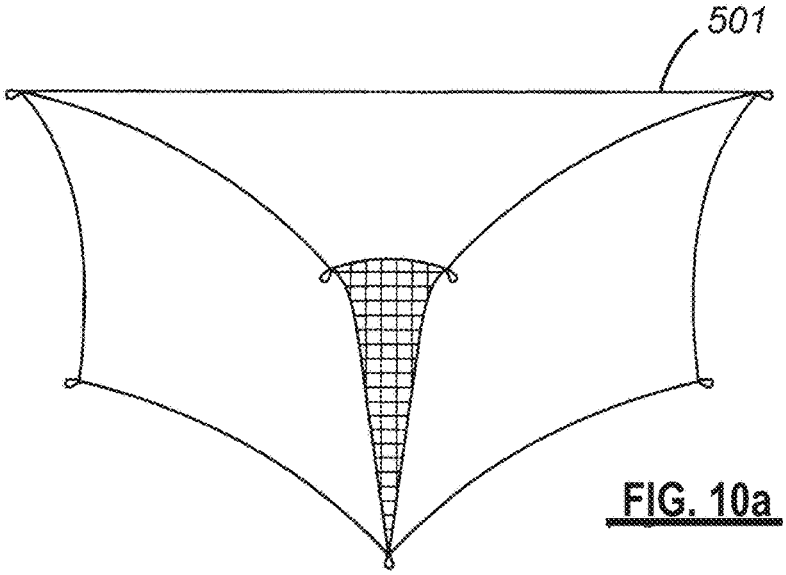
Figure 10B:
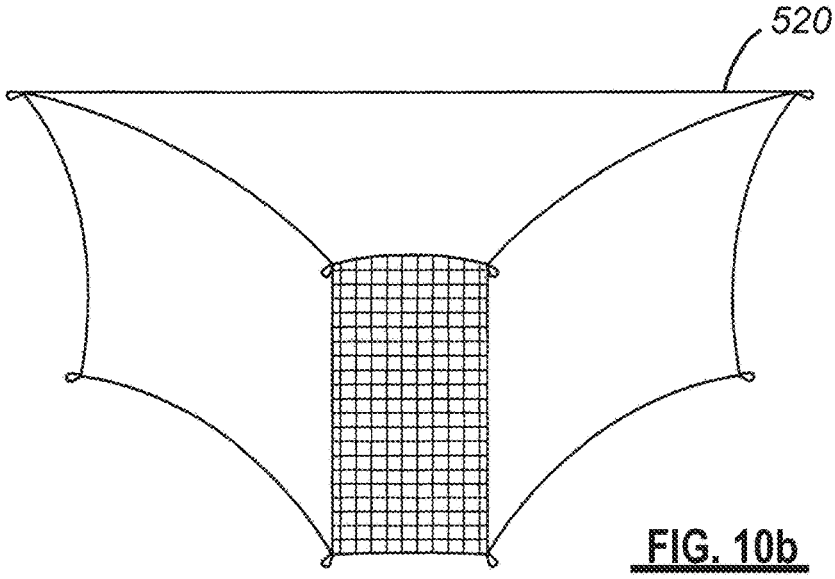
Figure 10C:
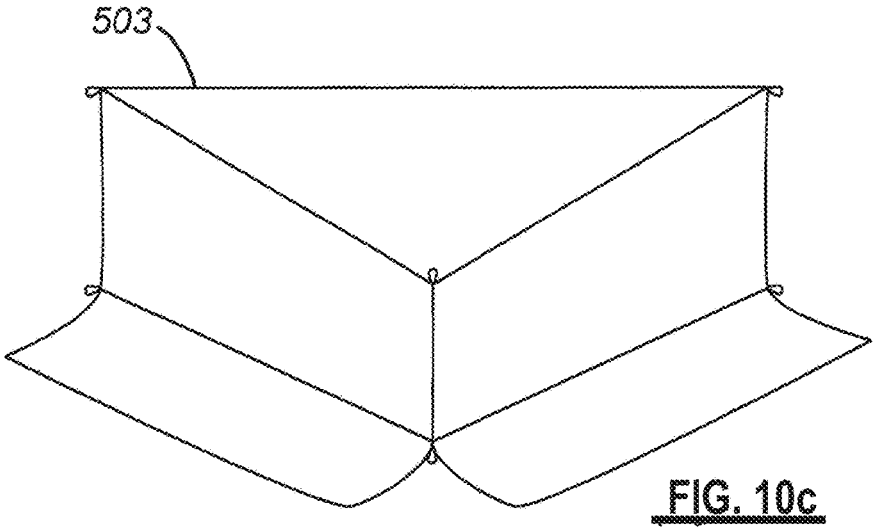
Figure 11A:
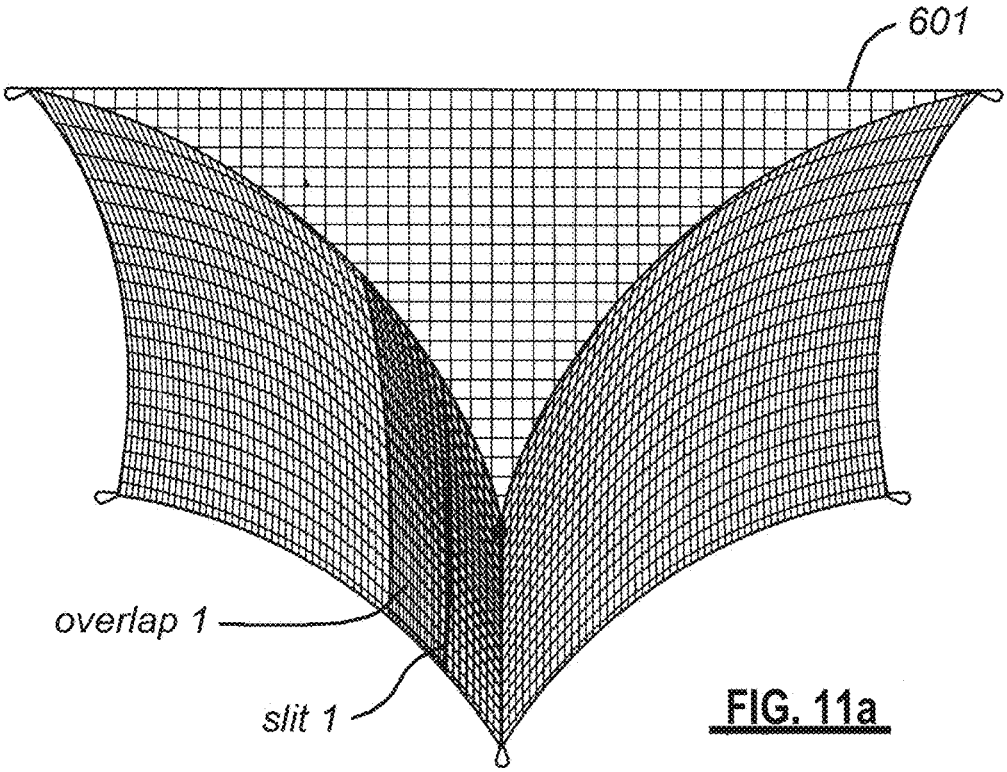
Figure 11B:
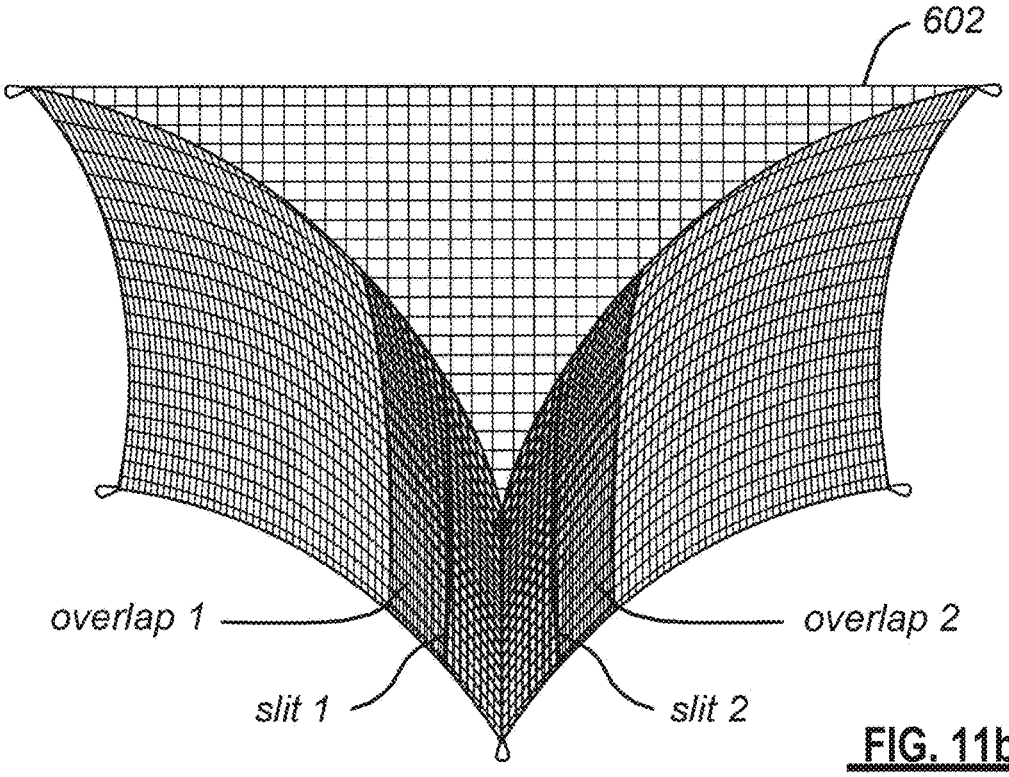
Figure 12:
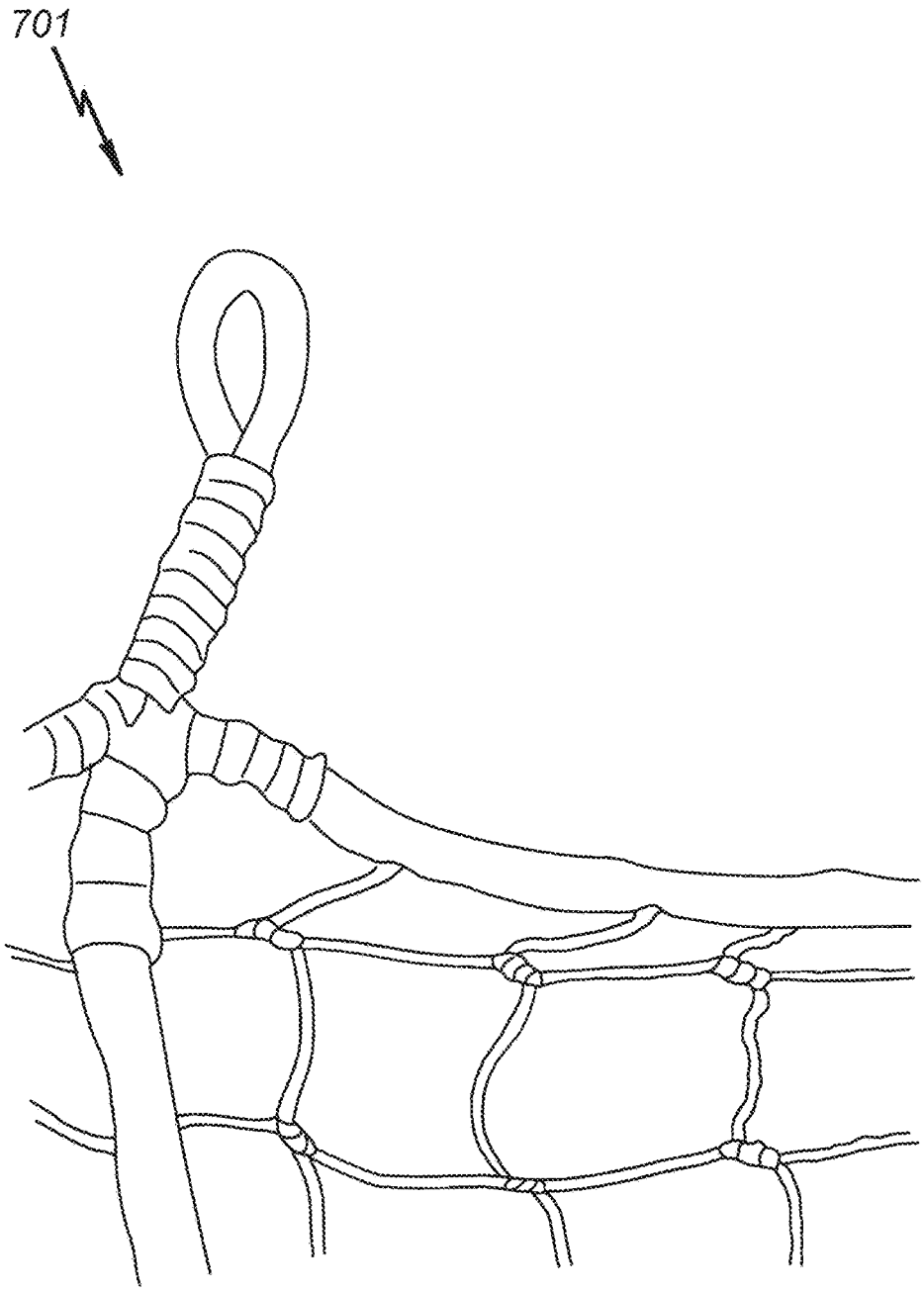
Figures 13A, 13B, 13C:
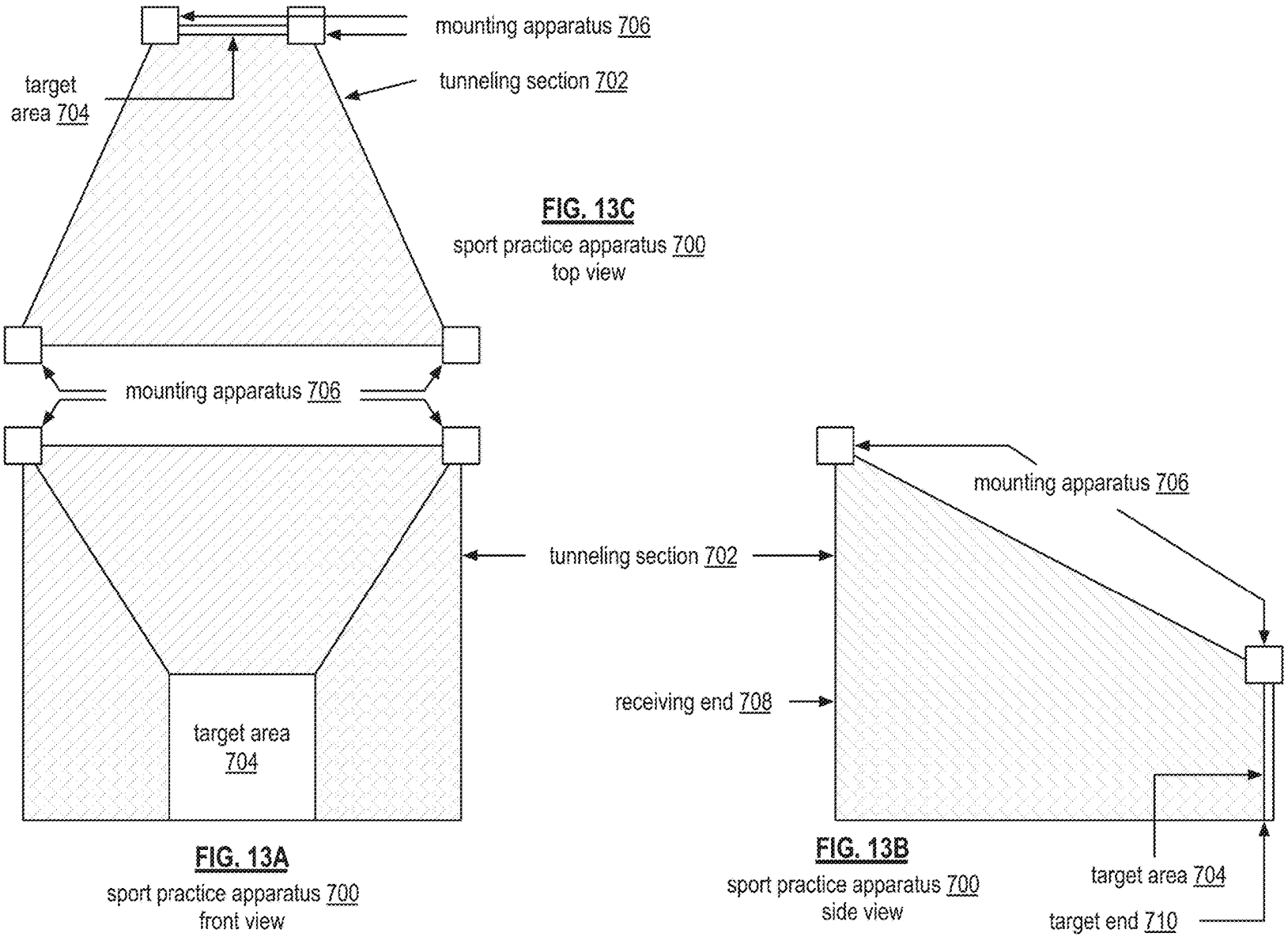
Figure 14:
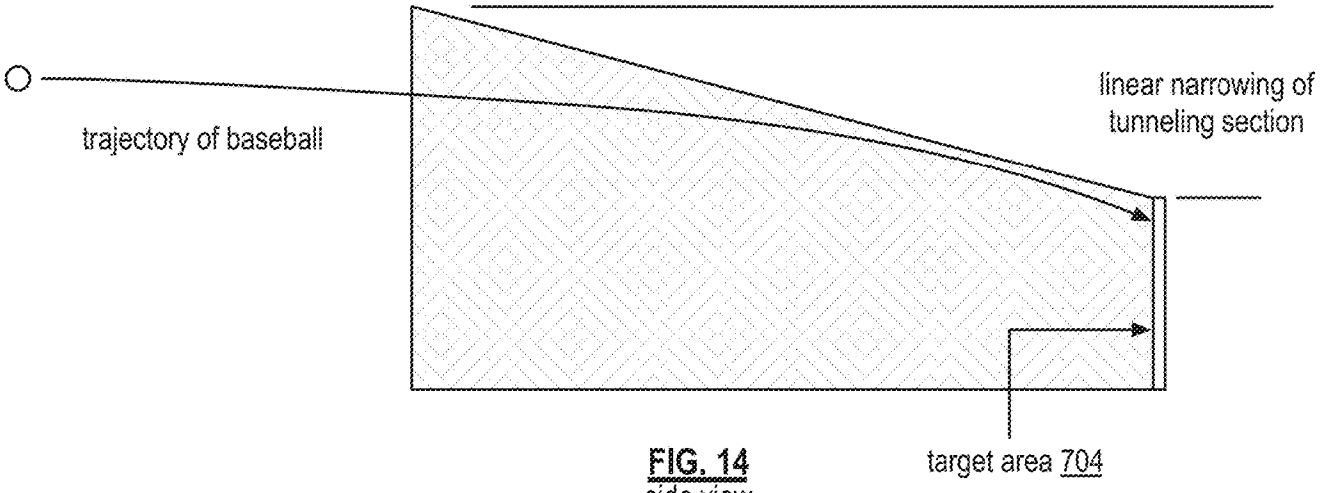
Figure 15:
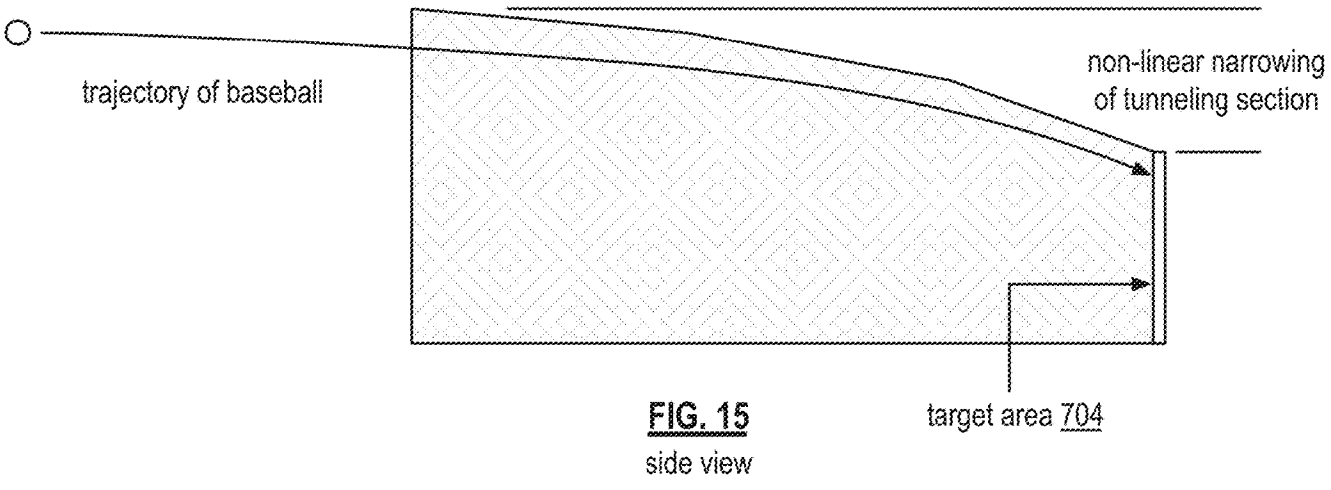
Figure 16:
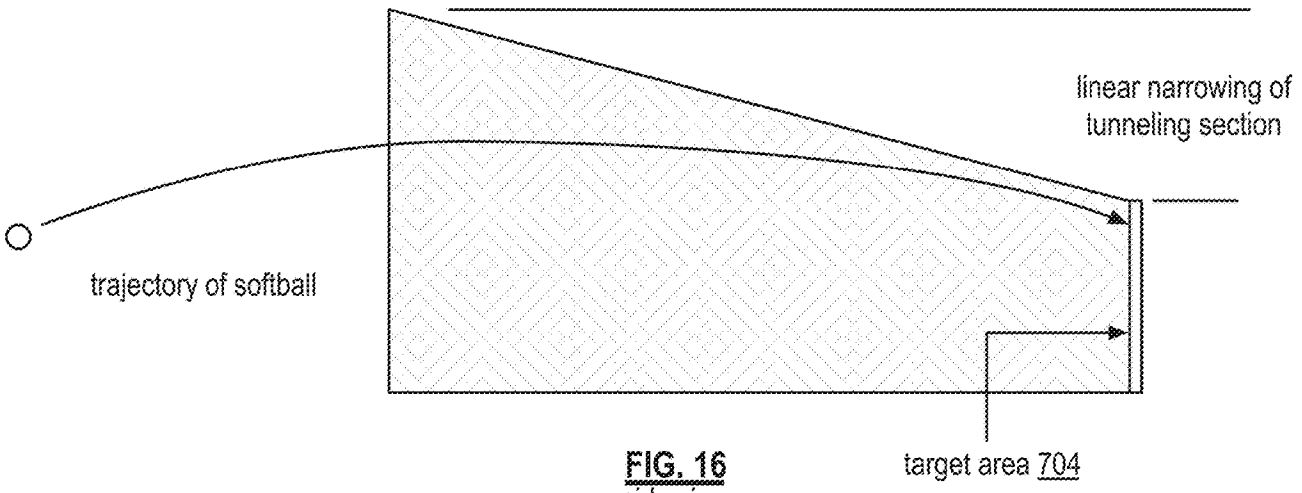
Figure 17:
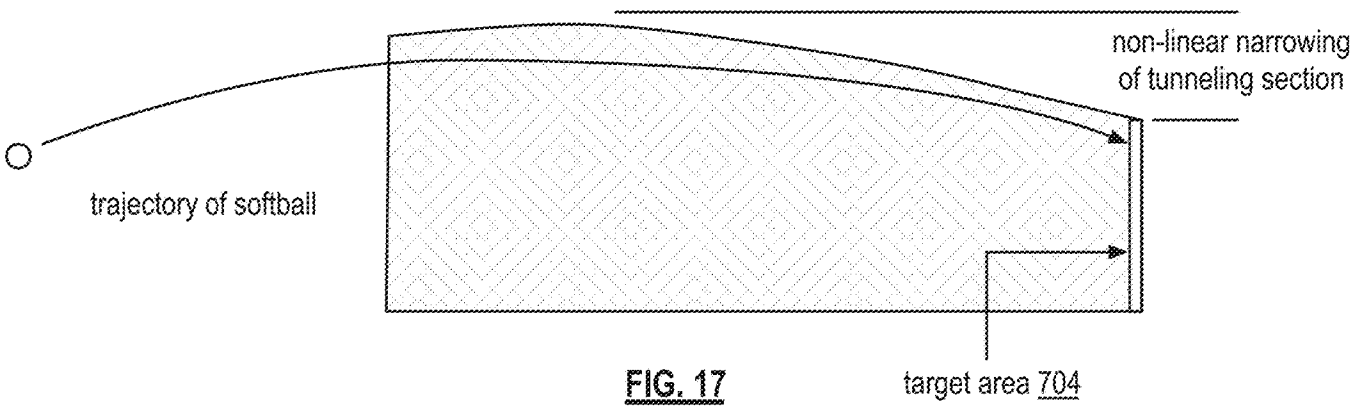
Figures 18A, 18B, 18C:
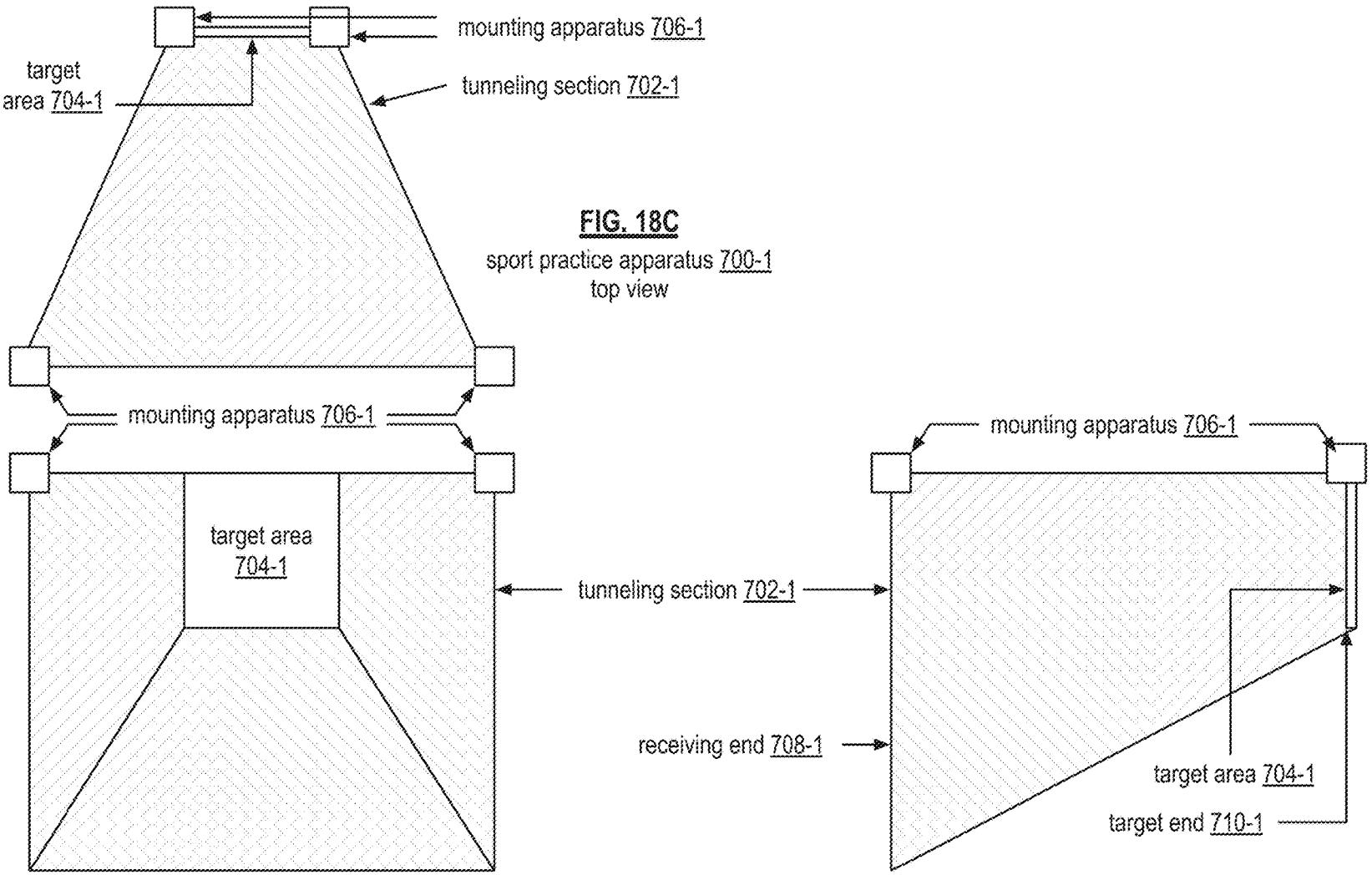
Figure 19:
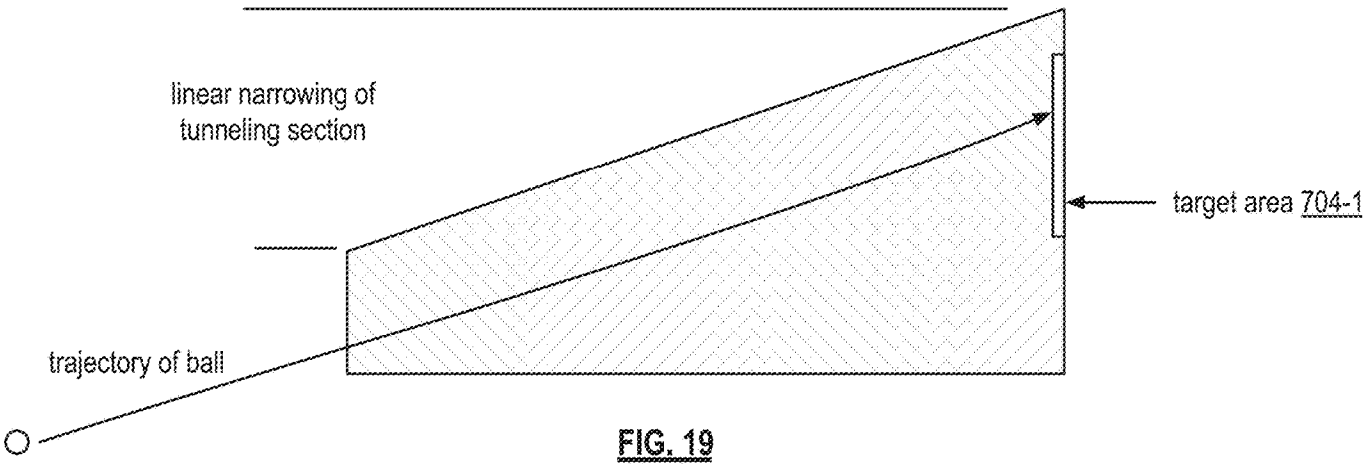
Figure 20:
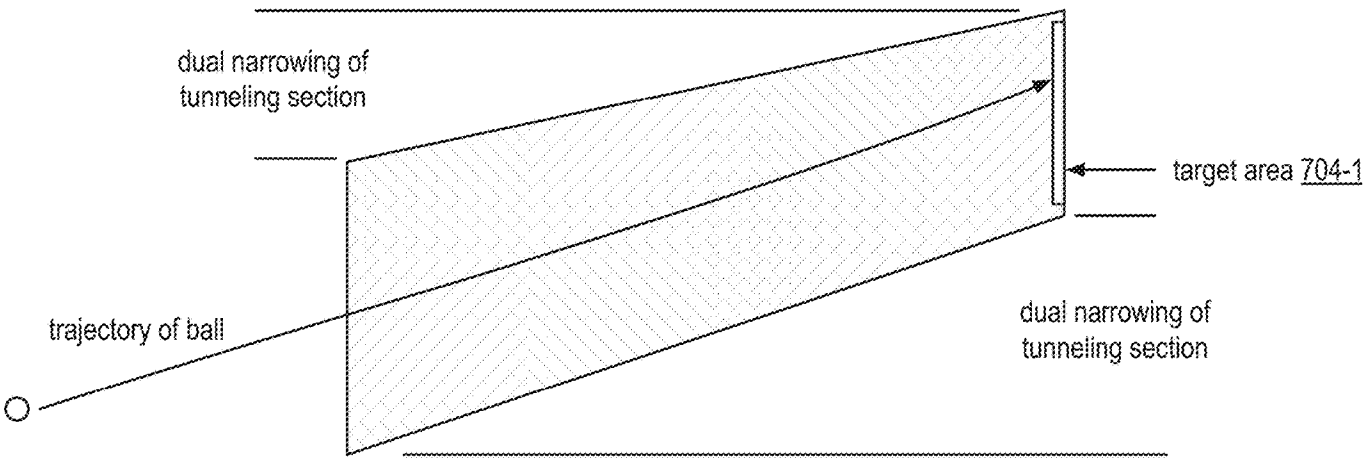
Figure 22:
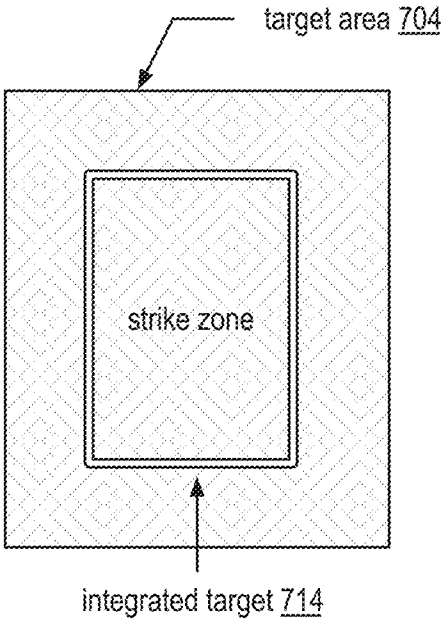
Figure 21:
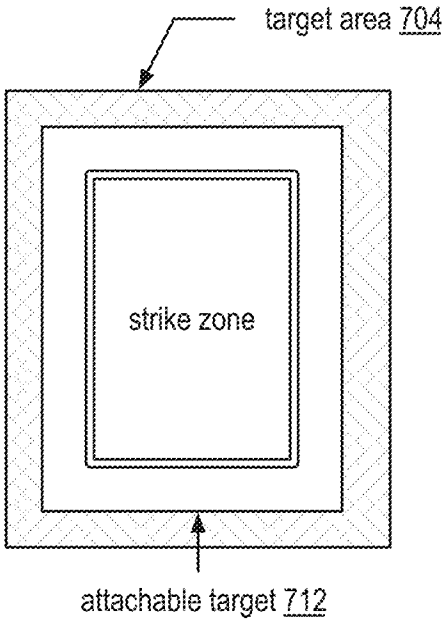
Figures 23A, 23B:
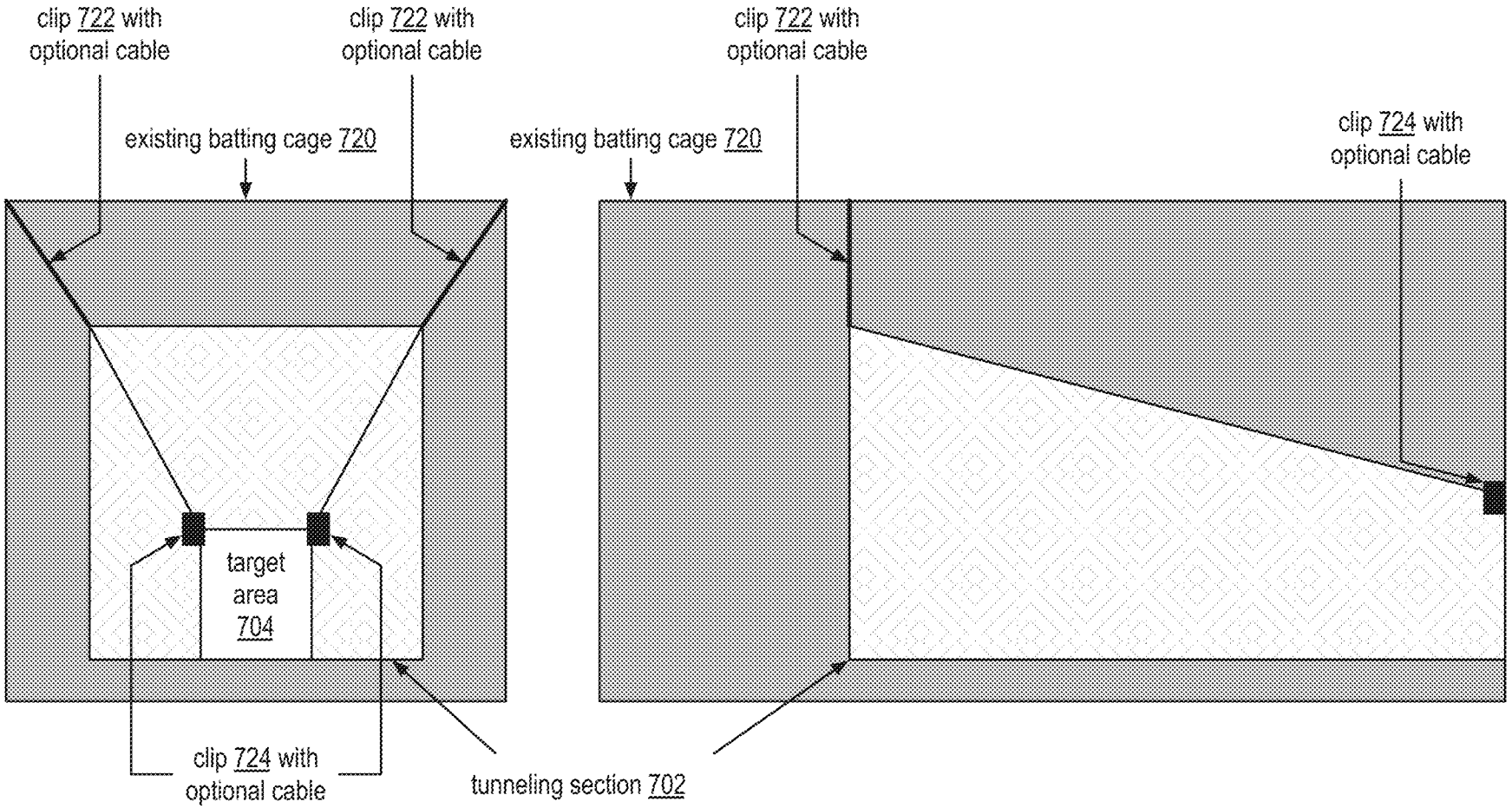
Figures 24A, 24B:
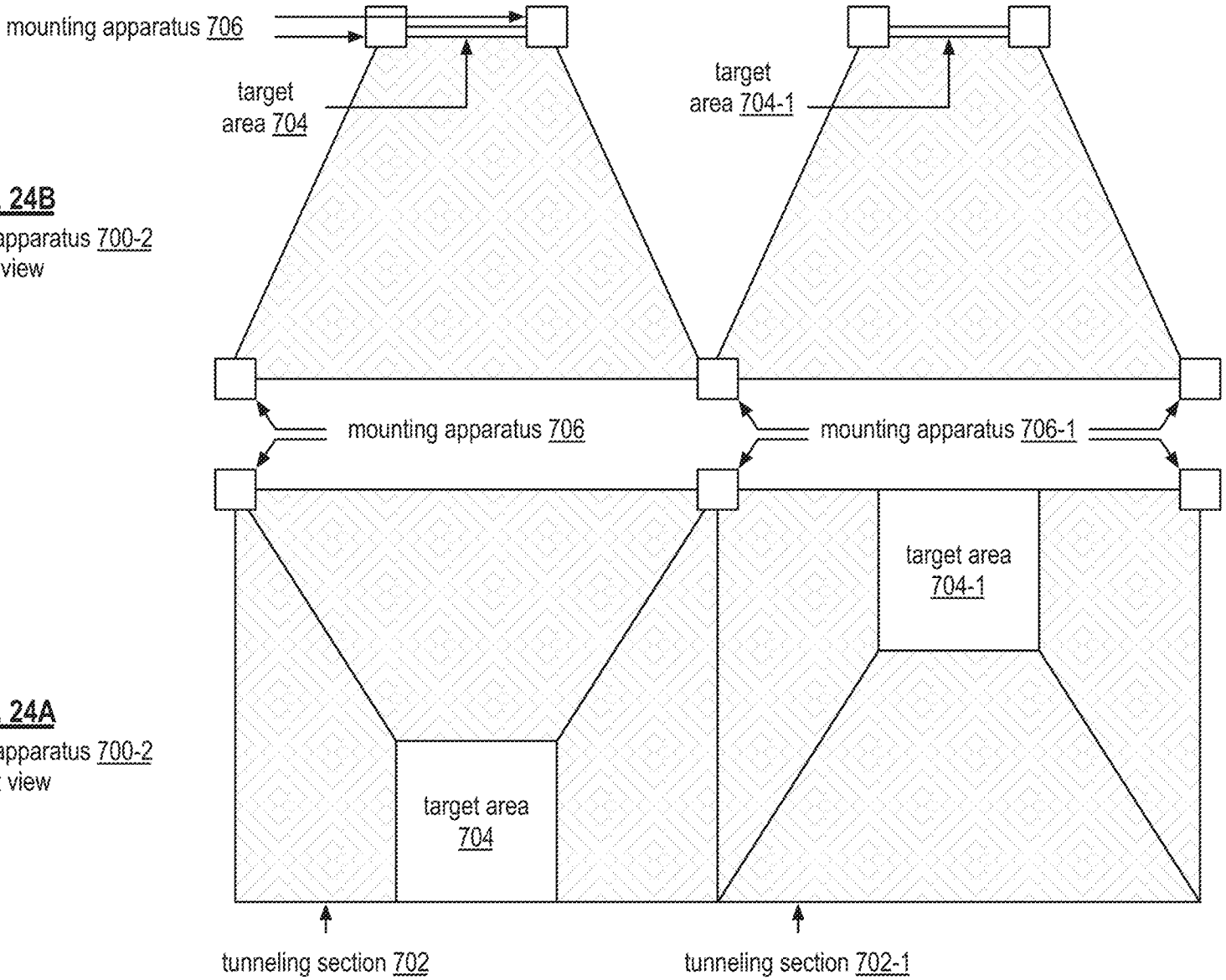
Figures 25A, 25B:
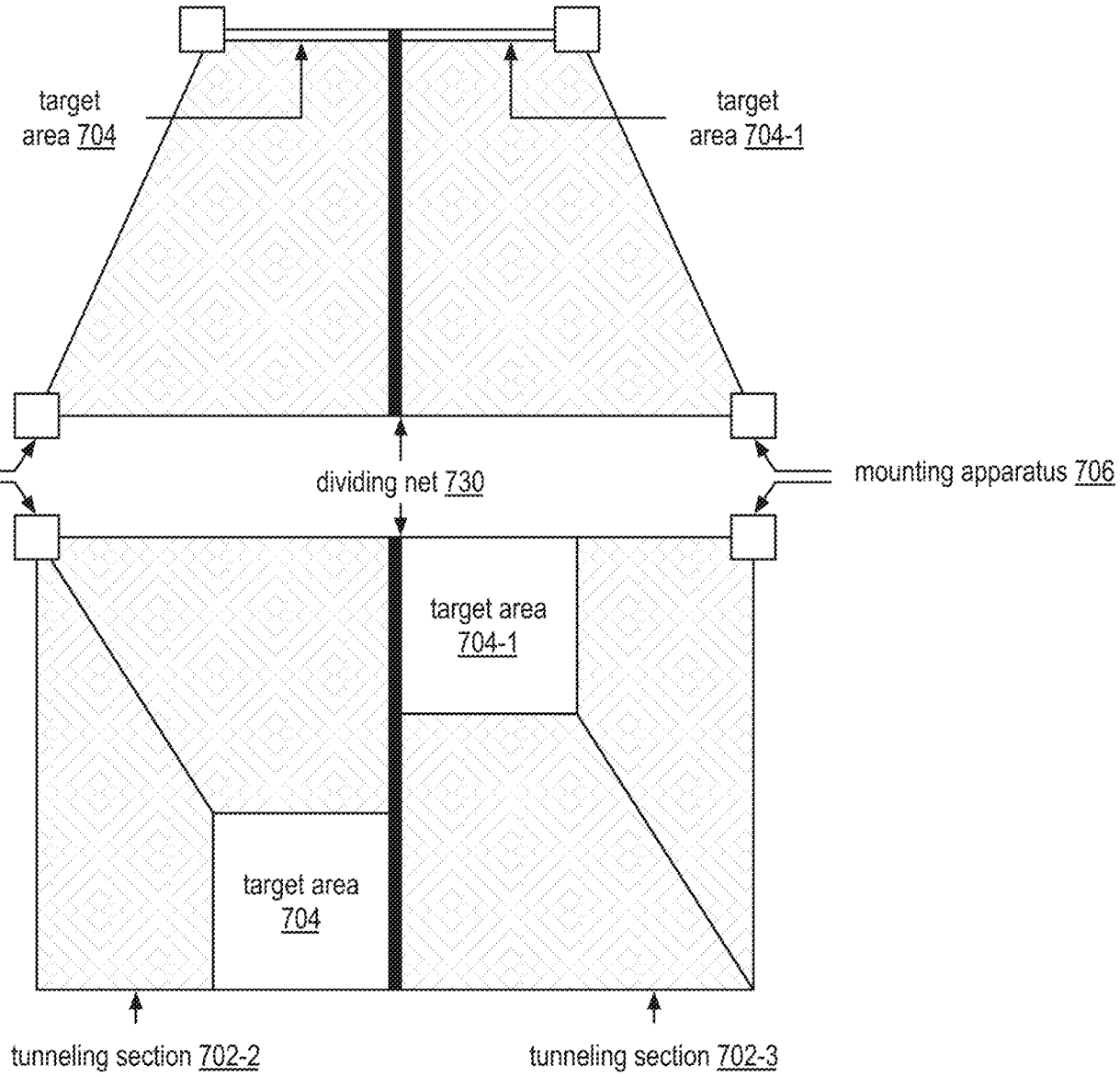
Figures 26A, 26B:
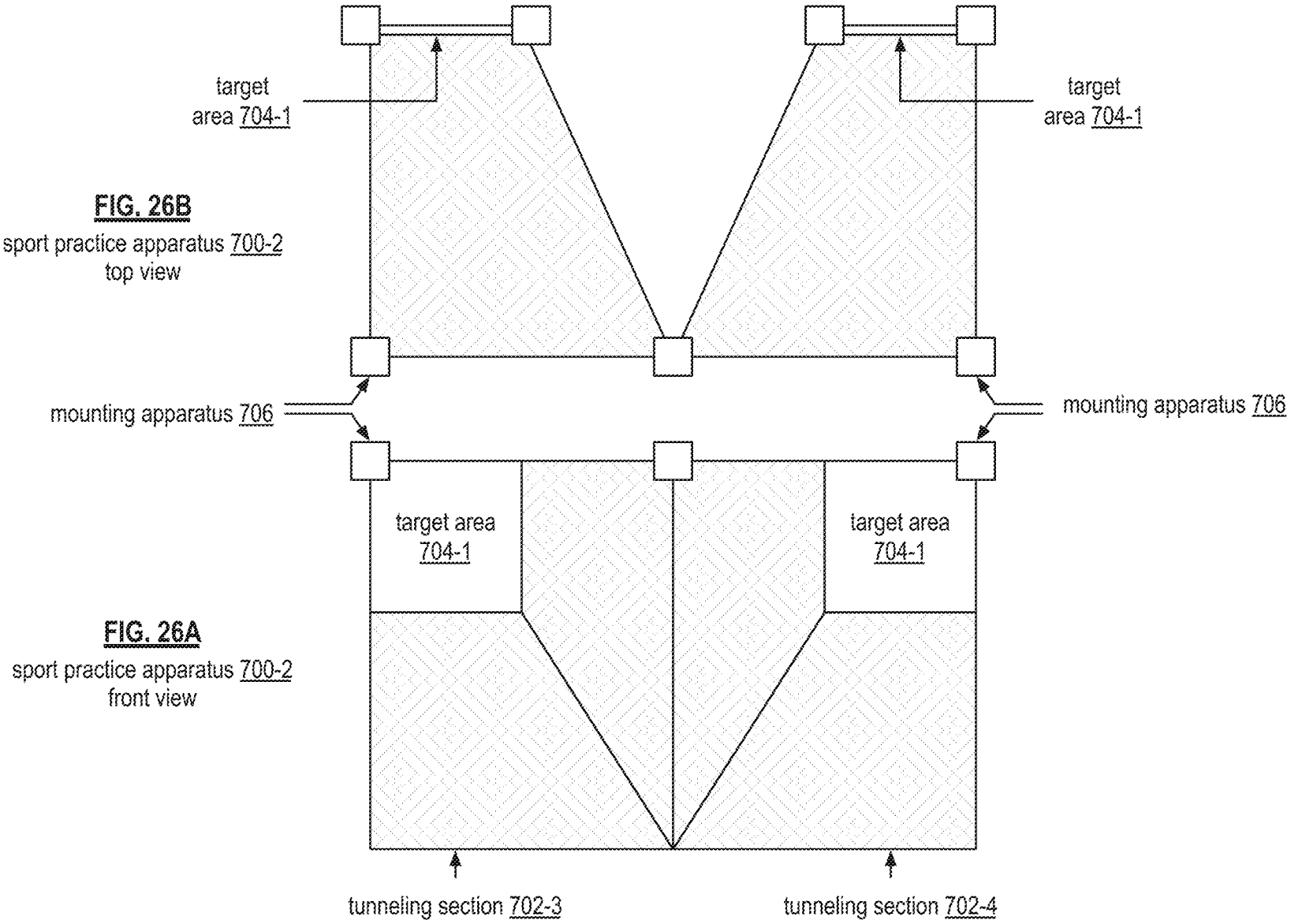
Figure 27B:
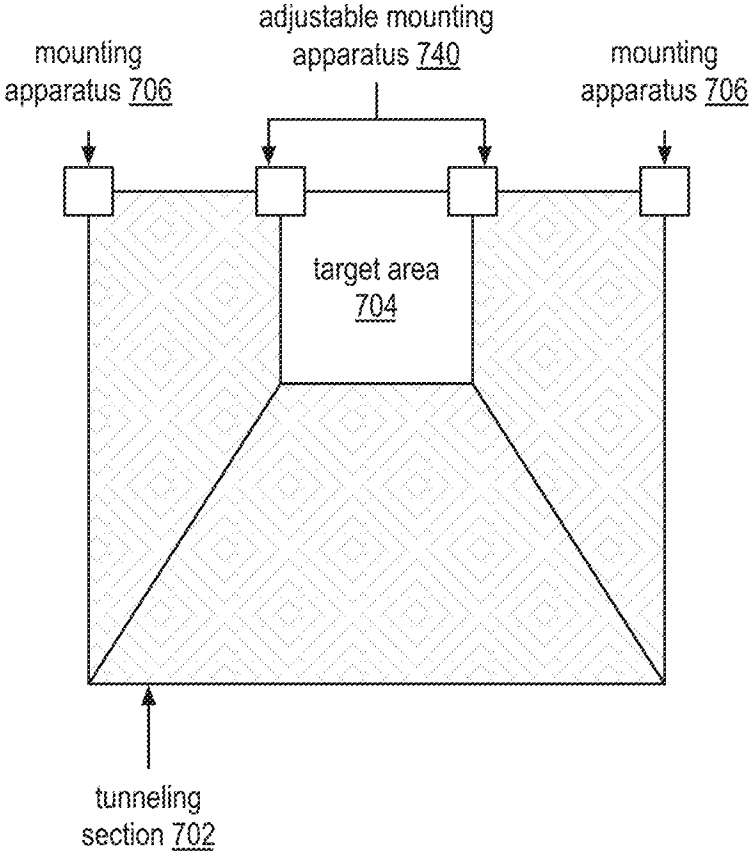
Figure 27A:
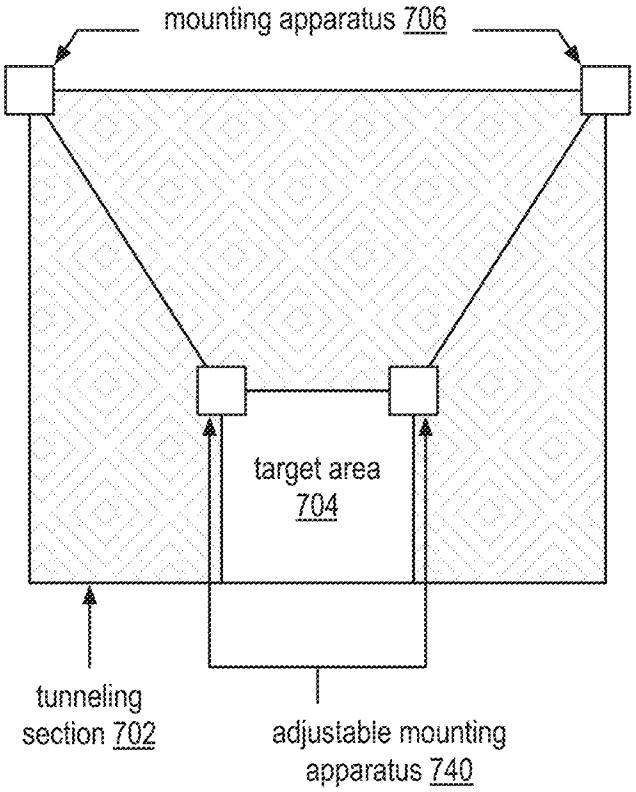

FIGS. 7*a* through 7*d* are diagrams of another embodiment of a three-piece netting structure for a pitching tunnel in accordance with the present invention;

FIGS. 8*a* and 8*b* are diagrams of another embodiment of a four-piece netting structure for a pitching tunnel in accordance with the present invention;

FIGS. 9*a* and 9*b* are diagrams of another embodiment of a netting structure for a pitching tunnel in accordance with the present invention;

FIGS. 9*c* through 9*f* are example embodiments, from an inside perspective, of a target end of a sports practice apparatus in accordance with the present invention;

FIGS. 10*a* through 10*c* are example embodiments, from an outside perspective, of a target end of a sports practice apparatus in accordance with the present invention;

FIGS. 11*a* and 11*b* are example embodiments, from an outside perspective, of a target end of a sports practice apparatus including one or more slits in accordance with the present invention;

FIG. 12 is a diagram of an embodiment of a tie point of a pitching tunnel's netting structure in accordance with the present invention;

FIGS. 13*a* through 13*c* are front, side, and top view diagrams of an example embodiment of a sports practice apparatus in accordance with the present invention;

FIG. 14 is a side view diagram of another example embodiment of a sports practice apparatus in accordance with the present invention;

FIG. 15 is a side view diagram of another example embodiment of a sports practice apparatus in accordance with the present invention;

FIG. 16 is a side view diagram of another example embodiment of a sports practice apparatus in accordance with the present invention;

FIG. 17 is a side view diagram of another example embodiment of a sports practice apparatus in accordance with the present invention;

FIGS. 18*a* through 18*c* are front, side, and top view diagrams of another example embodiment of a sports practice apparatus in accordance with the present invention;

FIG. 19 is a side view diagram of another example embodiment of a sports practice apparatus in accordance with the present invention;

FIG. 20 is a side view diagram of another example embodiment of a sports practice apparatus in accordance with the present invention;

FIG. 21 is a front view diagram of an example embodiment of a target end of a sports practice apparatus in accordance with the present invention;

FIG. 22 is a front view diagram of another example embodiment of a target end of a sports practice apparatus in accordance with the present invention;

FIGS. 23A and 23B are front and side view diagrams of another example embodiment of a sports practice apparatus in accordance with the present invention;

FIGS. 24A and 24B are front and top view diagrams of another example embodiment of a sports practice apparatus in accordance with the present invention;

FIGS. 25A and 25B are front and top view diagrams of another example embodiment of a sports practice apparatus in accordance with the present invention;

FIGS. 26A and 26B are front and top view diagrams of another example embodiment of a sports practice apparatus in accordance with the present invention; and FIGS. 27A and 27B are front and top view diagrams of an example embodiment of an adjustable sports practice apparatus in accordance with the present invention.

DETAILED DESCRIPTION OF THE INVENTION

Figure 1:
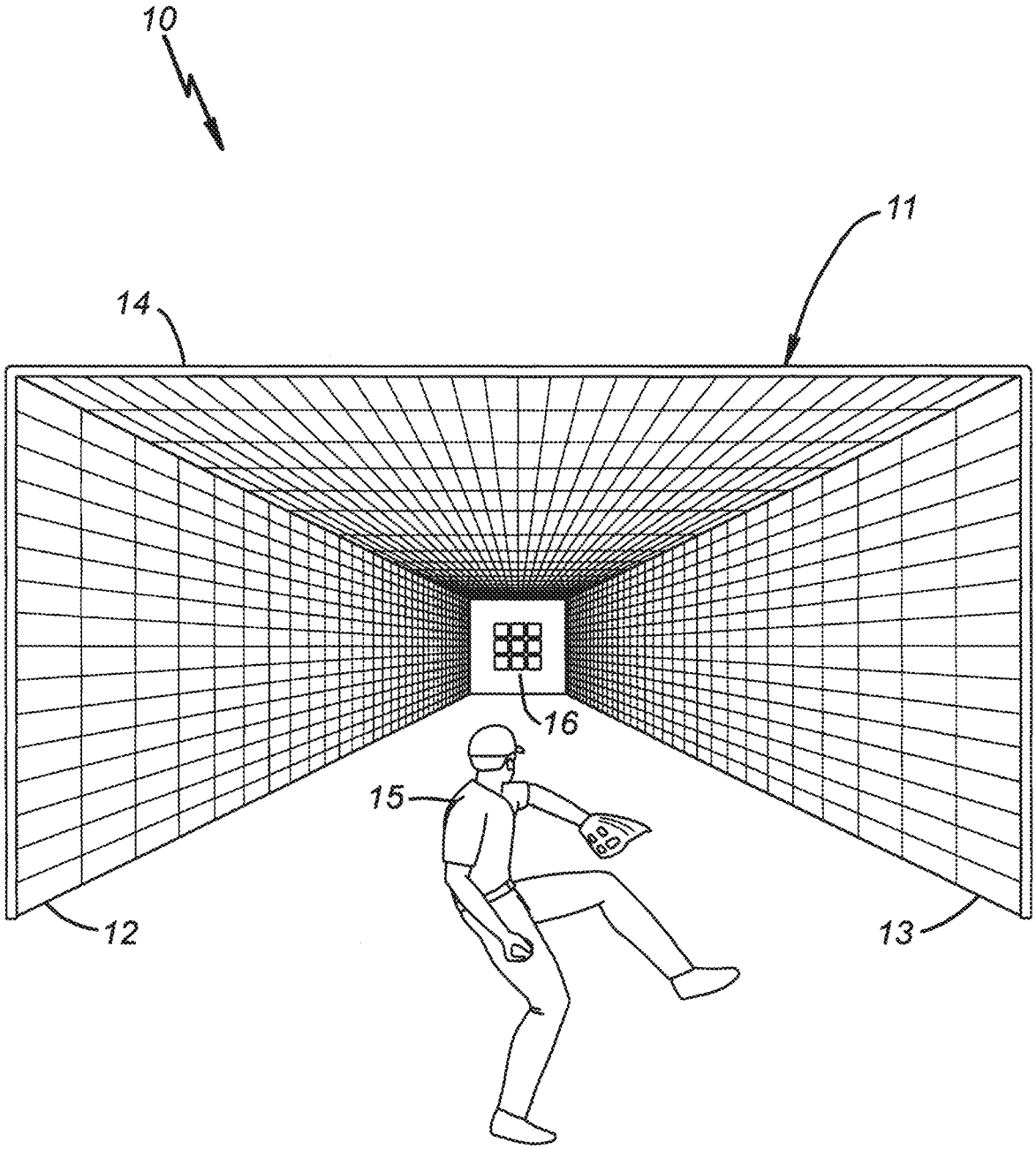
FIG. 1 is a diagram on an example of a pitcher practicing with a one-tie-point pitching tunnel in accordance with the present invention.

FIG. 1 of the drawings shows a one-tie-point pitching tunnel constructed according to the present invention that is identified as a pitching tunnel 10. Generally, the pitching tunnel 10 includes a body of netting 11 that is supported in the operative configuration of the body of netting 11 that is shown in FIG. 1, so that the pitching tunnel 10 includes a left side panel 12, a right side panel 13, and a top panel 14. In an operative configuration, the panels 12, 13, and 14 extend from a proximal end portion of the pitching tunnel 10 (i.e., a near end that is referred to herein as a "pitcher end portion") to a distal end portion of the pitching tunnel 10 (i.e., a distant end that is referred to herein as a "target end portion"). A pitcher 15 occupies a position in front of the pitcher end portion while pitching baseballs at a target 16 mounted within the target end portion. The body of netting 11 helps confine and collect the baseballs at the target end portion for later retrieval by the pitcher 15.

Figure 2:
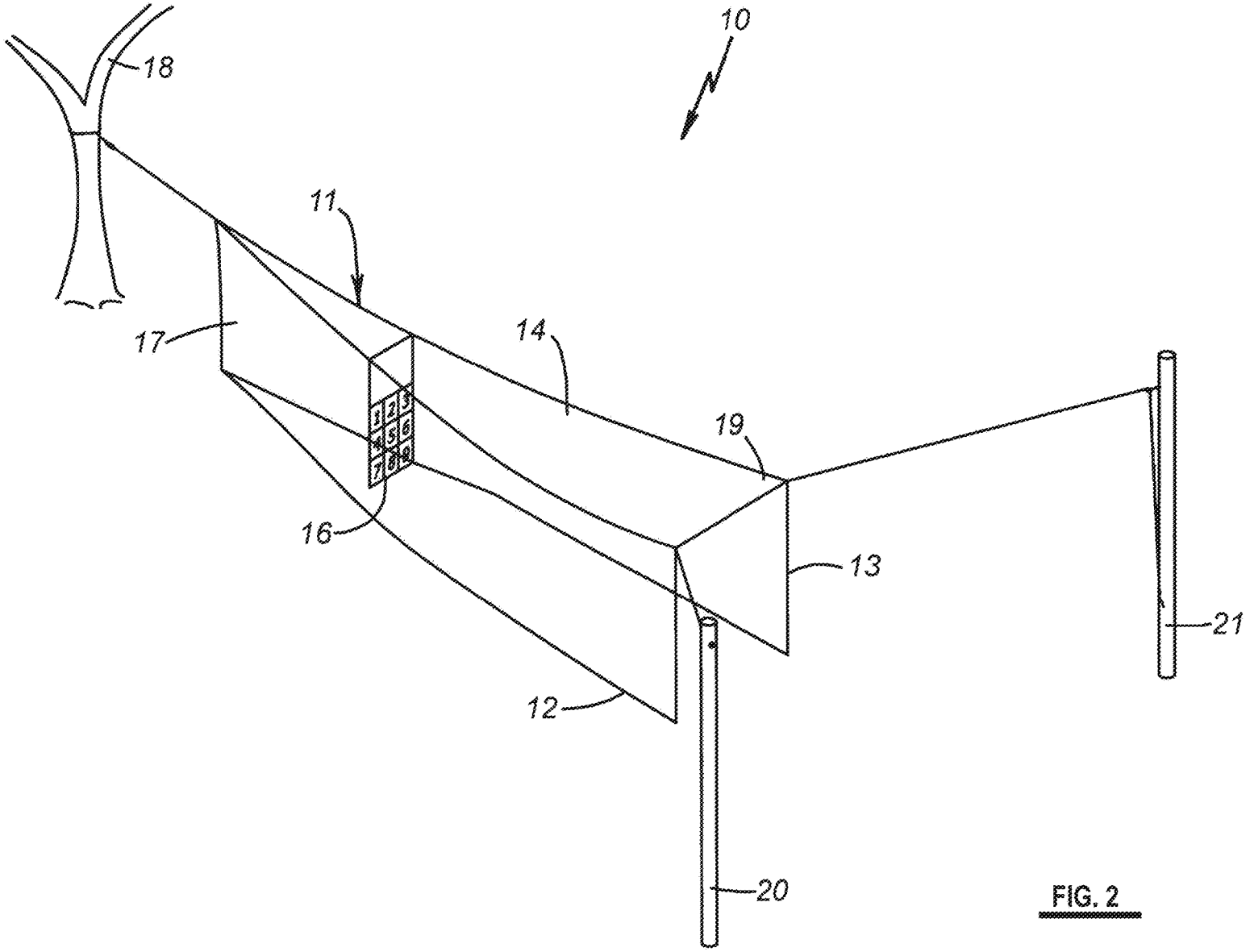
FIG. 2 is a diagram of an embodiment of a one-tie-point pitching tunnel with its target end tied to a tree in accordance with the present invention.

FIG. 2 shows the target end portion of the pitching tunnel 10 (i.e., a target end portion 17) secured to a tree 18. The tree 18 represents any of various support structures providing an elevated tie point to which the target end portion 17 can be secured with a single tie (e.g., tree, pole, chain link fence, or building). A length of rope, cord, or other suitably flexible line is used to tie the target end portion 17 to the tree 18. As an example, the pitching tunnel includes a target end tie loop, first and second receiving end tie loops, and three suspension cables. The target end tie loop is coupled to the target end of the tunneling section (e.g., the netting 11) and to the first suspension cable for securing the pitching tunnel at the target end to a first support structure (e.g., a tree, a pole, or other object). The first and second receiving end tie loops are coupled to a first and second points of the receiving end of the tunneling section and to the second and third suspension cables for securing the receiving end of the pitching tunnel to two support structures (e.g., poles).

FIG. 2 also shows the pitcher end portion of the pitching tunnel 10 (i.e., a pitching end portion 19) secured to two poles 20 and 21. The poles 20 and 21 represent any of various support structures providing elevated, spaced apart tie points to which the pitcher end portion 19 can be secured with lengths of rope, cord, or other suitably flexible lines. So secured, the body of netting 11 is said to be in an operative configuration of the pitching tunnel 10.

Figure 3:
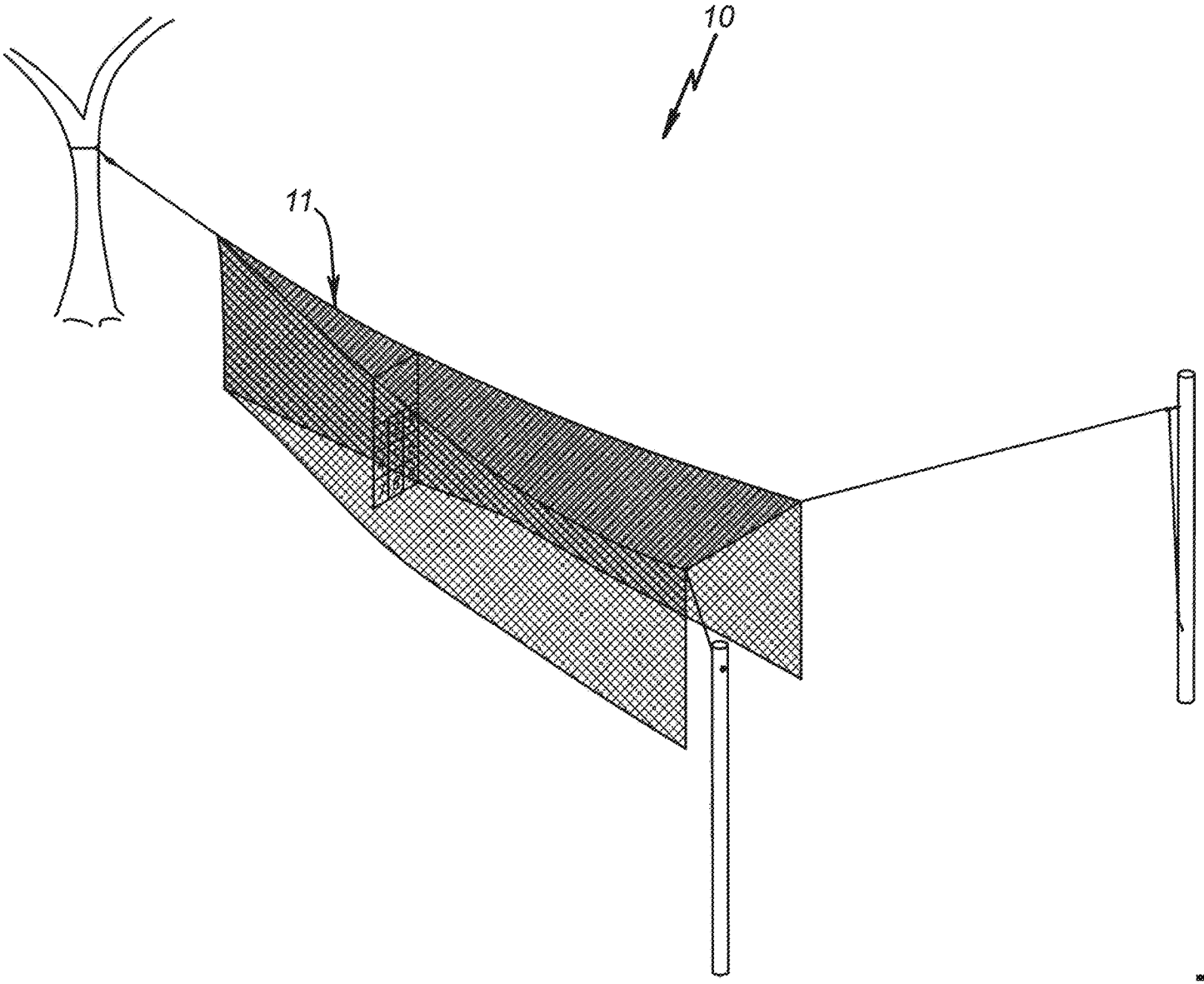
FIG. 3 is a diagram of another embodiment of a one-tie-point pitching tunnel in accordance with the present invention.
Figure 4:
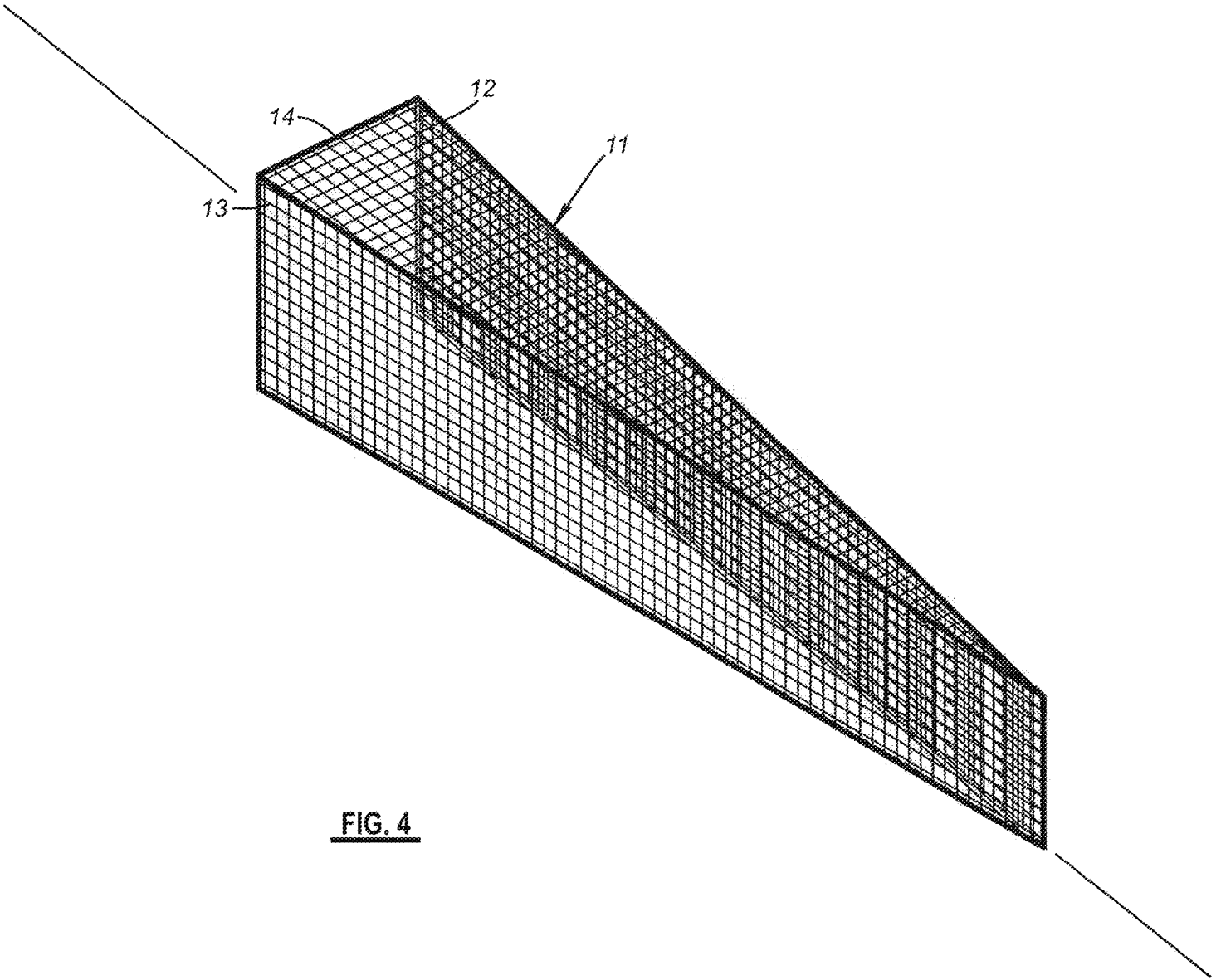
FIG. 4 is a diagram of another embodiment of a one-tie-point pitching tunnel in accordance with the present invention.

FIG. 3 is similar to FIG. 2, with the body of netting 11 emphasized, while FIG. 4 shows the body of netting 11 by itself, apart from the support structures (i.e., the tree 18 and the poles 20 and 21) and without ropes and tie loops. The body of netting 11 may, for example, take the form of a piece of commercially available baseball or golf netting. Such netting may include knotted netting with a square mesh pattern formed from treated black nylon twine. The openings are sufficiently small to stop passage of baseballs through the netting. Concerning the target 16, it may take the form of a commercially available or homemade target that identifies various spots in the strike zone of an average size batter. The target 16 is mounted within the pitching tunnel toward the target end portion 17 as illustrated.

Figure 5:
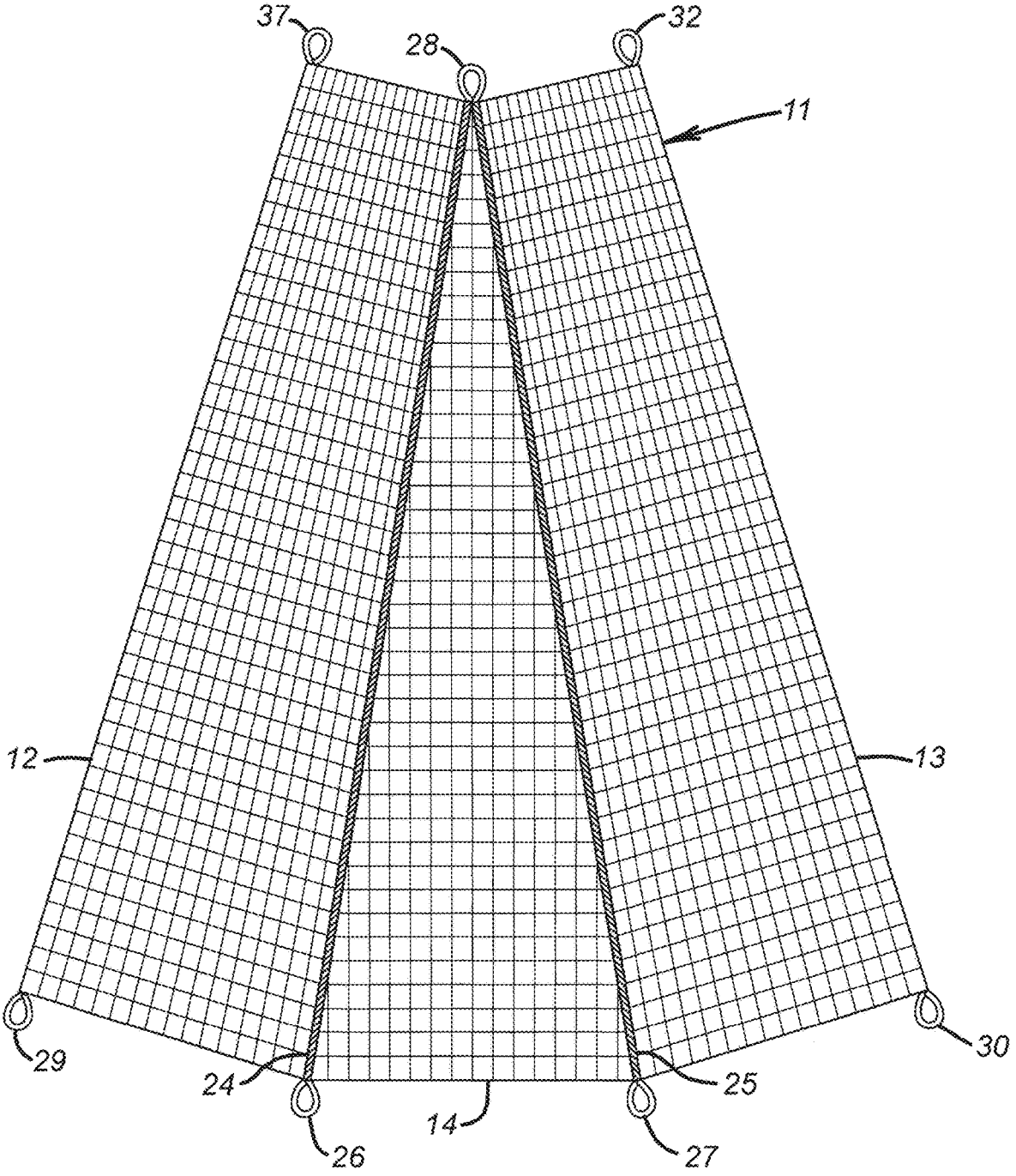
FIG. 5 is a diagram of an embodiment of a three-piece netting structure for a pitching tunnel in accordance with the present invention.

FIG. 5 is a planar view of the body of netting 11. It is shown flat in an unfolded configuration, as it would appear lying flat on the ground or other horizontal surface before being erected into the operative configuration mentioned earlier. The netting 11 includes a first side panel 12, a second side panel 13, and a top panel 14. The first side panel 12 has a first polygon shape (e.g., a trapezoid) and the second side panel 13 has a second polygon shape that is complimentary of the first polygon shape (e.g., a mirror of the trapezoidal shape of the first side panel). The top panel 14 is attached to the first and second side panels 12 and 13 and has a third polygon shape (e.g., a triangle).

As illustrated in FIG. 5, first and second ropes 24 and 25 extend from the pitcher end portion to the target end portion, threaded through and then secured onto the body of netting 11 in the positions indicated so that they define fold lines in the body of netting 11. The ropes 24 and 25 may take the form of lengths of ⅜-inch diameter 25 rope, for example, and 3/16-inch diameter nylon cordage may be wound around the ropes 24 and 25 in order to secure them to the body of netting 11.

Tie loops 26, and 27 (e.g., two-inch diameter loops) are included at the pitcher end portion on the ends of the first and second ropes 24 and 25 for use in securing lines to the body of netting 11 (i.e., tie lines that will be used to support the body of netting 11 in the operative configuration); similarly, a tie loop 28 is included at the target end portion where the first and second ropes 24 and 25 meet (i.e., the ropes 24 and 25 converge distally as shown). Similar tie loops 29, 30, 31, and 32 are preferably provided on the body of netting 11 also, for use in securing the marginal edges of the body of netting 11 downwardly (when in the operative configuration) as the lower marginal edges of the left and right side panels 12 and 13. The ropes and loops facilitate erection of the body of netting 11 into the operative configuration.

With the pitching tunnel 10 shaped and dimensioned as illustrated and described, only one elevated tie point is needed to support the distal end portion. As a further idea of the size of the illustrated pitching tunnel 10, the width of the side panels 12 and 13 at the pitcher end portion (i.e., the distance between the tie loops 26 and 29 and the distance between the tie loops 27 and 30) is about ten feet. The width of each of the side panels 12 and 13 at the target end portion (i.e., the distance between the tie loops 28 and 37 and the distance between the tie loops 28 and 32) is about seven feet, and the overall length (e.g., the distance between the tie loops 26 and 28 and 20 between the tie loops 27 and 28) is about 28 feet, while the width of the top panel 14 narrows distally from about ten feet at the pitcher end portion to less than one foot at a terminal end of the target end portion. Those dimensions apply for a pitching tunnel that is to be used by younger pitchers; bigger dimensions may apply for older pitchers, depending on various factors (e.g., their size and baseball skill). Of course, the body of netting 11 may take the form of a single piece of netting material, or it may take the form of multiple separate panels of netting material that are attached along their longitudinally extending marginal edge portions.

Figure 6:
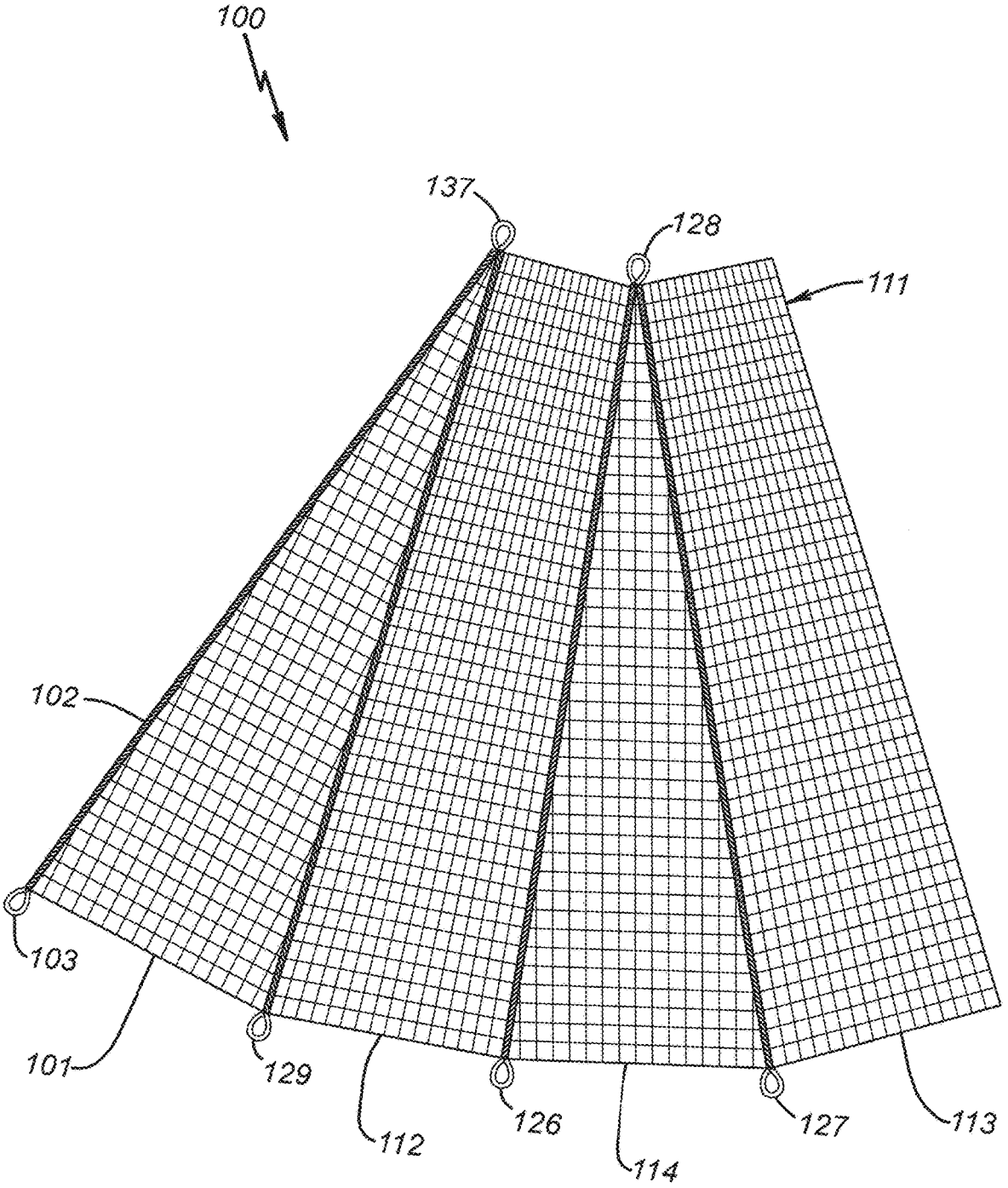
FIG. 6 is a diagram of an embodiment of a four-piece netting structure for a pitching tunnel in accordance with the present invention.

FIG. 6 shows a planar view of a second embodiment of a pitching tunnel 100 and is similar in many respects to the pitching tunnel 10. For convenience, reference numerals designating parts of the pitching tunnel 100 are increased by one hundred over those designating similar or related parts of the pitching tunnel 10. In this embodiment, the netting 111 includes first and second side panels 112 and 113, a top panel 114, and a bottom panel 101. The first side panel 112 has a first polygon shape (e.g., a trapezoid) and the second side panel 113 has a second polygon shape that is complimentary of the first polygon shape (e.g., a mirror of the trapezoidal shape of the first side panel). The top panel 14 is attached to the first and second side panels 112 and 113 and has a third polygon shape (e.g., a triangle). The bottom panel 101 is attached to the first and/or second side panels 112 and 113 and has a fourth polygon shape that is complimentary to the third polygon shape (e.g., a triangle that is a mirror image of the triangle shape of the top panel).

As shown, the bottom panel 101 extends from a proximal end portion of the pitching tunnel 100 to a distal end portion. A rope 102 extends along, and is secured to, a free marginal edge portion of the bottom panel 101 that is between a tie loop 103 at the proximal end portion and a tie loop 137 at the distal end portion. In an operative configuration of the body of netting 111 (i.e., an operative position of the pitching tunnel 100) the bottom panel 101 is disposed horizontally beneath the top panel 114 in order to further limit the travel of baseballs and thereby help confine them to the interior of the pitching tunnel 100. Note that the bottom panel 101 may lie on the ground or suspended above the ground at a desired distance.

FIGS. 7*a*, 7*b*, 7*c*, and 7*d* show plan views of various versions of a third embodiment of a pitching tunnel 200. The pitching tunnel 200 is similar in many respects to the pitching tunnel 10. For convenience, reference numerals designating parts of the pitching tunnel 200 are increased by two hundred over those designating similar or related parts of the pitching tunnel 10.

Figure 7A:
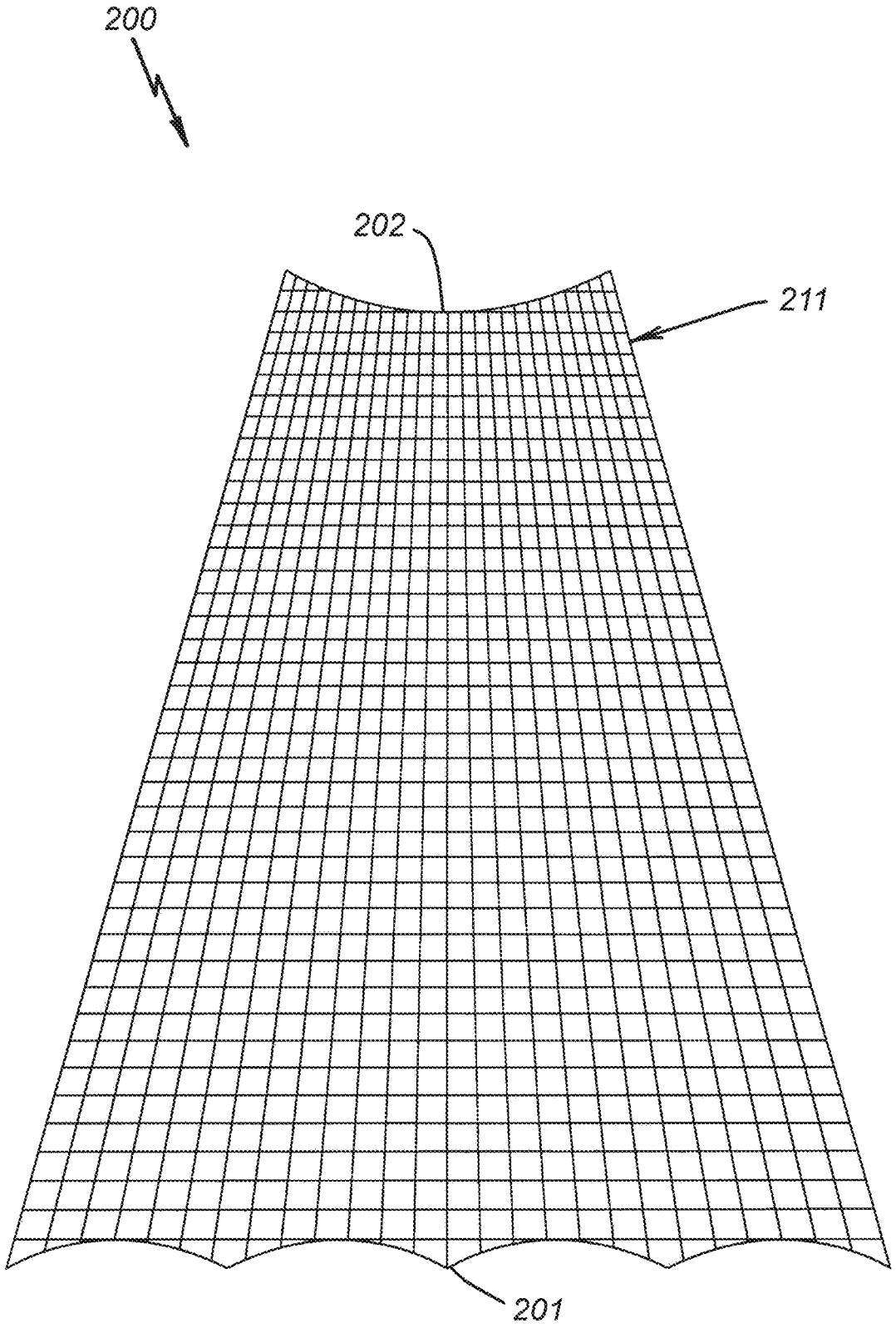

In FIG. 7*a*, a body of netting 211 is illustrated lying flat upon a horizontal surface with no ropes and no tie loops. The body of netting 211 extends between a proximal end portion 201 (i.e., a pitcher end portion 201) and a distal end portion 202 (i.e., a target end portion 202). The body of netting 211 can be erected into an operative configuration without ropes and tie loops, but, preferably, ropes and tie loops are included, at least to the extent illustrated in FIG. 7*b*.

Figure 7B:
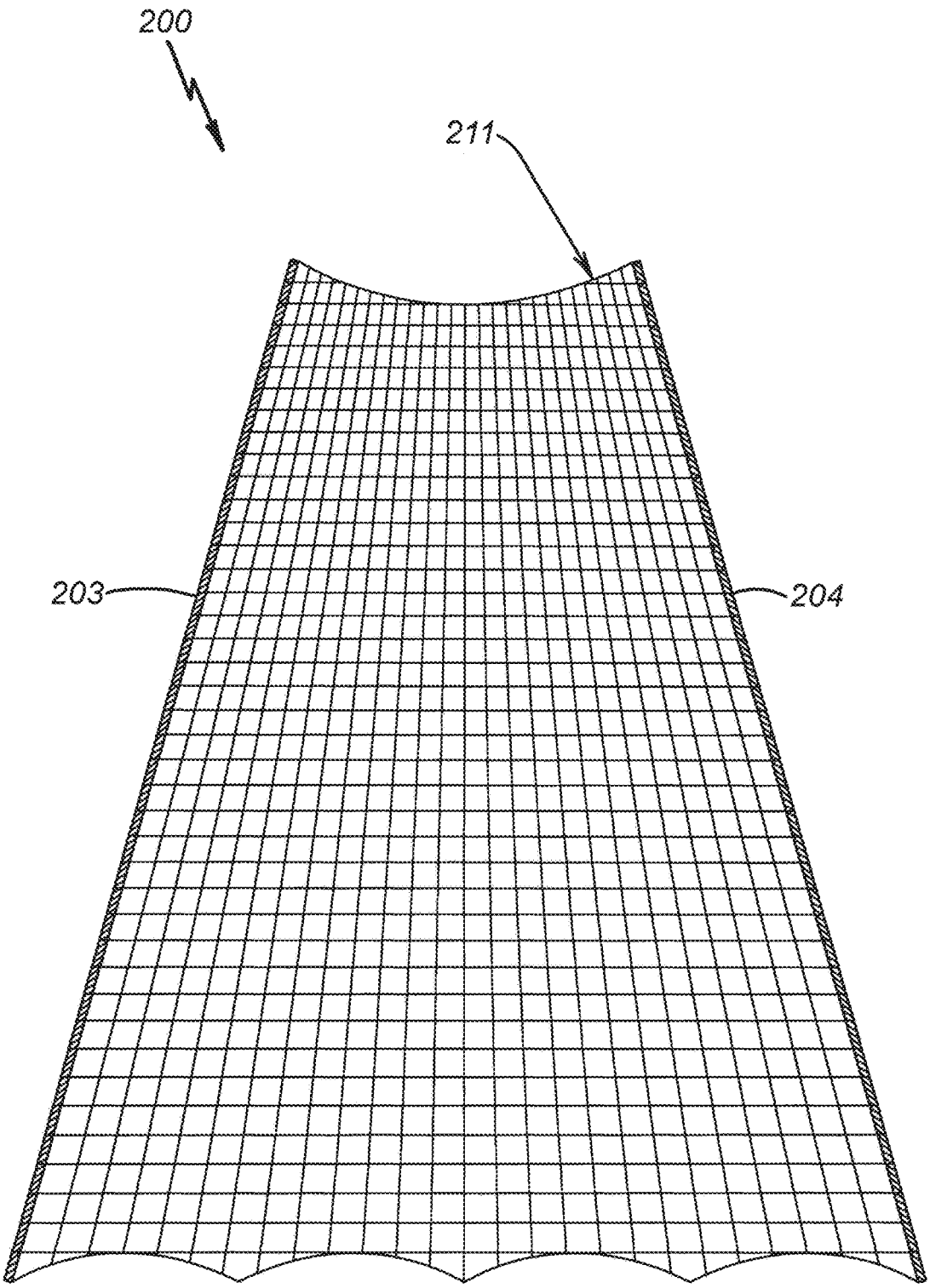
Figure 7C:
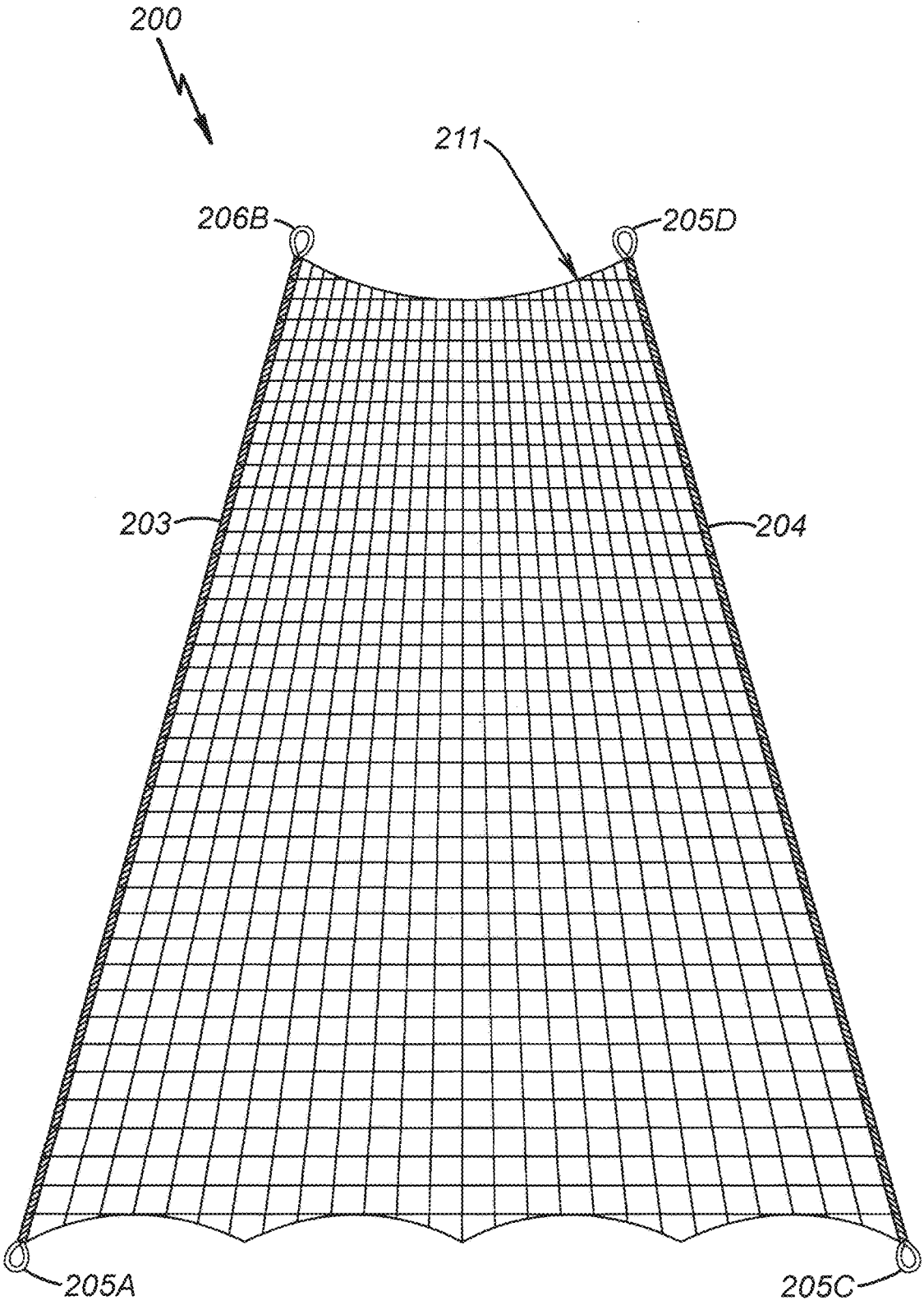
Figure 7D:
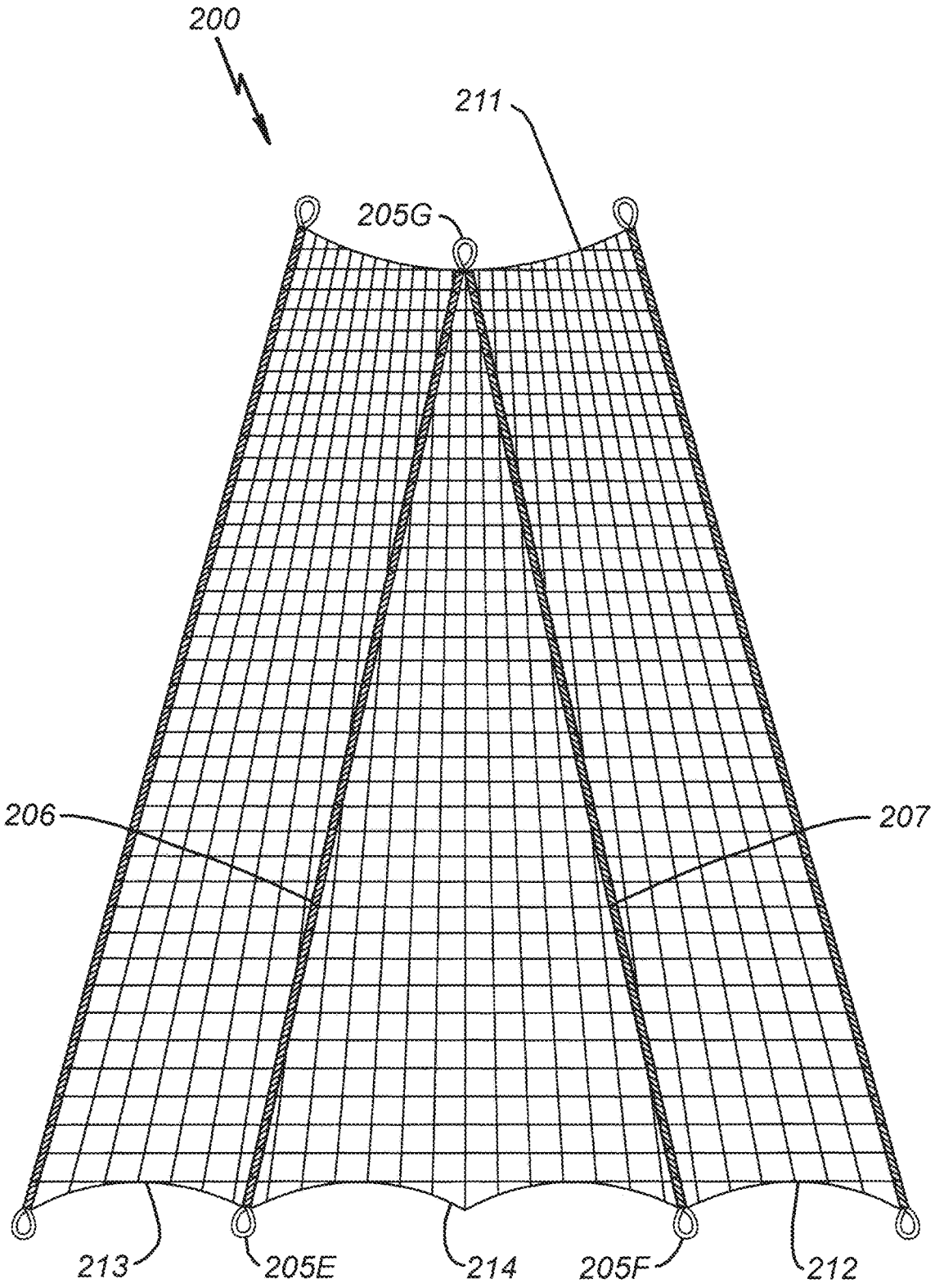

In FIG. 7*b*, the pitching tunnel 200 includes ropes 203 and 204 on the outer marginal edge portions of the body of netting 211. They facilitate erection of the body of netting 211 to the operative configuration. In FIG. 7*c*, tie loops 205A, 205B, 205C, and 205D have been added on the ends of the ropes 203 and 204 to further facilitate erection. In FIG. 7*d*, additional ropes 206 and 207 have been added between the top panel 214 and the right and left side panels 212 and 213, along with additional tie loops 205E, 205F, and 205G.

In the embodiment of FIG. 7*d*, the netting includes mounting apparatus, which, in turn, includes a target end tie loop 205G, a first receiving end tie loop 205E, a second receiving end tie loop 205F, and three suspension cables (e.g., rope, wire cable, nylon rope, etc.). The target end tie loop is coupled to the target end of the tunnel, the first receiving end tie loop is coupled to a first point of the receiving end of the tunnel, and the second receiving end tie loop is coupled to a second point of the receiving end of the tunnel. A first suspension cable is coupled to the target end tie loop; a second suspension cable is coupled to the first receiving end tie loop; and a third suspension cable is coupled to the second receiving end tie loop. To use the pitching tunnel, the first, second, and third suspension cables are secured to three support structures.

Turning now to FIGS. 8*a* and 8*b*, they illustrate various aspects of a fourth embodiment of the present invention that is identified as a convertible pitching tunnel 300. It is similar in some respects to the pitching tunnel 10, except that it includes a body of netting 311 that is shaped and dimensioned for erection in a batting-cage configuration, as illustrated in FIG. 8*a*, and in a pitching-tunnel configuration as illustrated in Fib. Sb. In the illustrated operative configurations, the body of netting 311 extends from a proximal end 301 of the convertible pitching tunnel 300 to a distal end 302. In the batting-cage configuration of FIG. Sa, a distal end panel 303 (a portion of the body of netting 311) is supported by two support structures (e.g., poles 304 and 305) in the expanded shape shown in FIG. 8*a*. In the batting-cage configuration of FIG. 8*b*, the distal end panel 303 is supported by only one support structure (e.g., a single pole 305), with the body of netting 311 converging distally toward the distal end panel 303 in an un-expanded shape.

Figure 9C:
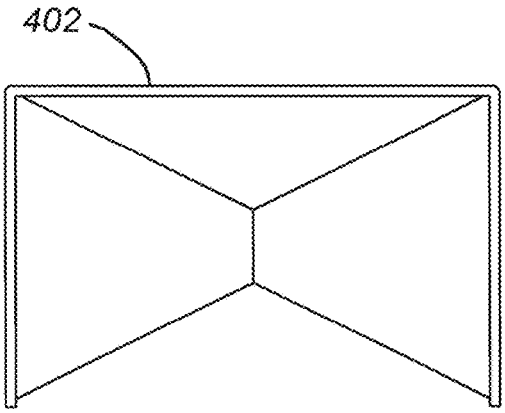

FIGS. 9*a*, 9*b*, 9*c*, 9*d*, 9*e*, and 9*f* are diagrammatic perspective views that illustrate various other aspects of a single-tie-point pitching tunnel constructed according to the present invention. FIG. 9*a* shows the pitcher end portion and left side of a first netting configuration 401 for which the terminal end of the target end portion lies along 10 a vertically extending line. FIG. 9*b* shows the pitcher end portion and right side of the first netting configuration 410. FIG. 9*c* shows the interior of the tunnel as viewed from the pitcher end portion of a second netting configuration 402 that has no bottom netting panel and, from the receiving end's perspective, a substantially linear shape.

Figure 9D:
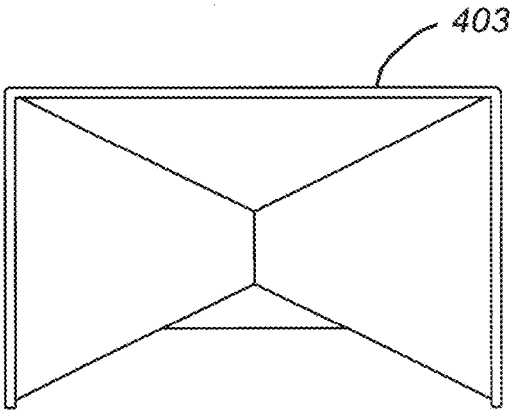

FIG. 9*d* shows the interior of the tunnel as viewed from the pitcher end portion of a third netting configuration 403 that has a partial bottom netting panel (i.e., a level portion) at the target end. The bottom netting panel may sit on the ground or be suspended a desired distance above the ground. In this embodiment, the target end has, from the receiving end's perspective, a substantially linear shape.

Figure 9E:
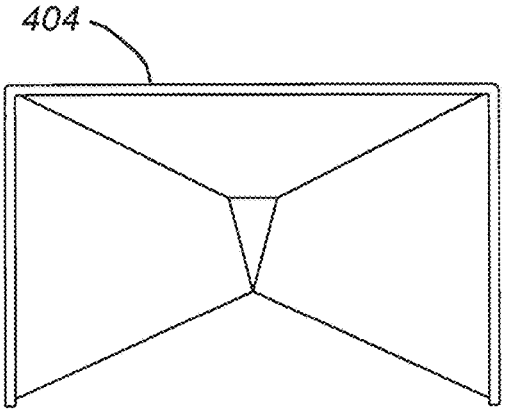

FIG. 9*e* shows a triangularly shaped terminal end of the target end portion of a fourth netting configuration 404 that has no bottom netting panel and, from the receiving end's perspective, a substantially triangular shape. The triangular shape is such that is surrounds a home plate for pitching and does not interfere with pitches that are over home plate. The embodiment of FIG. 9*e* may further includes the bottom panel.

Figure 9F:
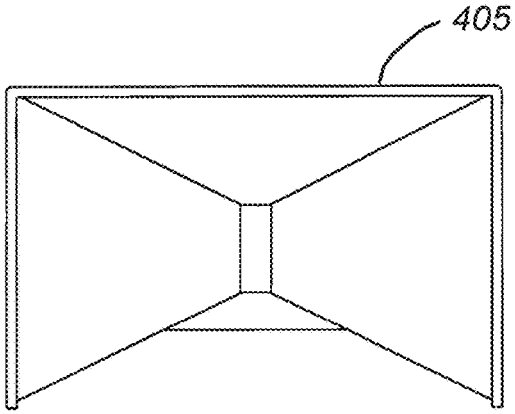

FIG. 9*f* shows a rectangular shaped terminal end of the target end portion of a fifth netting configuration 405 that has a partial bottom netting panel that is coupled to lower edge of the target area and to the netting of the tunnel. In addition, the target end has, from the receiving end's perspective, a substantially rectangular shape.

FIGS. 10*a*, 10*b*, and 10*c* are diagrammatic perspective views of various terminal end portions as viewed looking toward them from a viewpoint beyond the terminal end portions. FIG. 10*a* illustrates a configuration 501 that has a triangularly shaped terminal end portion. A configuration 502 in FIG. 10*b* shows a rectangular shaped terminal end portion, A configuration 503 in FIG. 10*c* shows a straight-line terminal end portion (i.e., the side panels meet along a vertically extending line).

FIGS. 11*a* and 11*b* are diagrammatic perspective views of various back door entry way aspects of the distal end portion. FIG. 11*a* illustrates a first pitching tunnel configuration 601 that includes overlapping netting with a slit arranged to provide a door into the tunnel. FIG. 11*b* illustrates a second pitching tunnel configuration 602 that includes overlapping netting with slits arranged on both sides that provide two back doors. The netting is overlapped and bound together suitably to provide the entry ways. The door, or doors, provide an entry section at target end of the tunnel for allowing retrieval of the sports balls (e.g., baseballs, softballs, golf balls, soccer balls, footballs, Lacrosse balls, etc.).

FIG. 12 illustrates an example of a tie loop that is identified as a tie loop 701. It may be formed, for example, by looping the end of a piece of rope, and then retaining the end of the rope in the loop shape with nylon cord. Nylon cord may also be used to secure the loop 701, and the rope, to the netting.

FIGS. 13*a* through 13*c* are front, side, and top view diagrams of an example embodiment of a sports practice apparatus 700 that includes a tunneling section 702, a target area 704, and mounting apparatus 706. The tunneling section 702 has a receiving end 708 and a target end 710. The target area 704 is proximal to the target end 710 and the athlete using the sports practice apparatus is proximal to the receiving end 708. For example, a pitcher throws a baseball into the receiving end 708 towards the target area 704 at the target end 710. The tunneling section is constructed of a material that prevents a sports ball (e.g., baseball, softball, golf ball, football, soccer ball, Lacrosse ball, etc.) from existing the tunneling section other than at the target end. Note that the tunneling section may be contrasted in accordance with one or more of FIGS. 1-12 and the material may be one or more of a mesh netting having an "x" inch spacing ("x" is smaller than the diameter of the sports ball), cloth, vinyl, canvas, and plastic.

As shown, the tunneling section 702 narrows from the receiving end towards the target end in the x-x plane, in the x-z plane, and/or the y-z plane. In an embodiment, the narrowing of the tunneling section 702 follows a trajectory that conforms to desired trajectory of a sports ball set into motion during practice. Examples of this are shown and discussed with reference to FIGS. 14-17.

As is further shown, the tunneling section 702 is operably associated with the target area 704. For example, the tunneling section 702 is operably associated with the target area 704 when the target area 704 is a back panel of the tunneling section 702. As another example, the tunneling section 702 is operably associated with the target area 704 when a target is secured to the tunneling section 702 (e.g., as shown in FIG. 2). The mounting apparatus 706 may be implemented in a variety of ways to couple the tunneling section 702 to one or more supporting structures (e.g., a tree, a pole, a hook on a building, within an existing batting cage, etc.). Various examples of the mounting apparatus 706 have been provided in one or more preceding figures and in one or more subsequent figures.

The length of the tunneling section 702 may vary depending on the sport, available space, and/or desired type of training. For example, if the sports training apparatus is used for baseball and/or softball, the length (e.g. from the receiving end 708 to the target end 701) is of a dimension that is equal to or less than a dimension from a pitching rubber to a home plate. As a specific example, the length is 60.5 feet or less.

FIG. 14 is a side view diagram of another example embodiment of a sports practice apparatus 700 wherein an upper edge of the tunneling section 702 has a linear narrowing that follows the trajectory of a baseball. In this manner, the tunneling section is narrowed corresponding to the trajectory of a thrown baseball.

FIG. 15 is a side view diagram of another example embodiment of a sports practice apparatus 700 wherein an upper edge of the tunneling section 702 has a non-linear narrowing that follows the trajectory of a baseball. In an example to provide the non-linear narrowing, the tunneling section is cut in a pattern that follows the non-linear trajectory of a thrown baseball and includes multiple tie loops to support the non-linear narrowing shape. In another example to provide the non-linear narrowing, the tunneling section includes tubing that follows the non-linear trajectory of a thrown baseball. The netting of the tunneling section is secured to the tubing.

FIG. 16 is a side view diagram of another example embodiment of a sports practice apparatus 700 wherein an upper edge of the tunneling section 702 has a linear narrowing that follows the trajectory of a softball. In this manner, the tunneling section is narrowed corresponding to the trajectory of a thrown softball.

FIG. 17 is a side view diagram of another example embodiment of a sports practice apparatus 700 wherein an upper edge of the tunneling section 702 has a non-linear narrowing that follows the trajectory of a softball. In an example to provide the non-linear narrowing, the tunneling section is cut in a pattern that follows the non-linear trajectory of a fast-pitched softball and includes multiple tie loops to support the non-linear narrowing shape. In another example to provide the non-linear narrowing, the tunneling section includes tubing that follows the non-linear trajectory of a fast-pitched softball. The netting of the tunneling section is secured to the tubing.

FIGS. 18*a* through 18*c* are front, side, and top view diagrams of another example embodiment of a sports practice apparatus 700-1 that includes a tunneling section 702-1, a target area 704-1, and mounting apparatus 706-1. The tunneling section 702-1 has, from a side view, a trapezoid shape that narrows from a receiving end 708-1 to a target end 710-1 in an upward manner. The target area 704-1 is proximal to the target end 710-1 and the athlete using the sports practice apparatus is proximal to the receiving end 708-1. The tunneling section 702-1 is constructed of a material that prevents a sports ball (e.g., baseball, softball, golf ball, football, soccer ball, Lacrosse ball, etc.) from existing the tunneling section other than at the target end. Note that the tunneling section may be contrasted in accordance with one or more of FIGS. 1-12 and the material may be one or more of a mesh netting having an "x" inch spacing ("x" is smaller than the diameter of the sports ball), cloth, vinyl, canvas, and plastic.

As shown, the tunneling section 702-1 narrows from the receiving end 708-1 towards the target end 710-1 in the x-x plane, in the x-z plane, and/or the y-z plane. In an embodiment, the narrowing of the tunneling section 702 follows a trajectory that conforms to desired trajectory of a sports ball (e.g., a struck golf ball, a kicked soccer ball, etc.) set into motion during practice. Examples of this are shown and discussed with reference to FIGS. 19 and 20.

The length of the tunneling section 702-1 may vary depending on the sport, available space, and/or desired type of training. For example, if the sports training apparatus is used for golf, the length (e.g. from the receiving end 708-1 to the target end 701-1) is 4-20 feet or more, where the golfer sets up very close to the opening of the receiving end 708-1.

FIG. 19 is a side view diagram of another example embodiment of a sports practice apparatus 700-1 wherein an upper edge of the tunneling section 702-1 has a linear narrowing that follows the trajectory of a golf ball or soccer ball. In this manner, the tunneling section is narrowed corresponding to the trajectory of a hit golf ball or a kicked soccer ball.

FIG. 20 is a side view diagram of another example embodiment of a sports practice apparatus 700-1 wherein an upper edge and the lower edge of the tunneling section 702-1 has a linear narrowing that follows the trajectory of a golf ball or soccer ball. In this manner, the tunneling section is narrowed corresponding to the trajectory of a hit golf ball or a kicked soccer ball.

FIG. 21 is a front view diagram of an example embodiment of a target area 704 of a sports practice apparatus 700. An attachable target 712 is mounted within the target area 704. The target 712 is a separate material (e.g., canvas, plastic, rubber, cloth, etc.) and is mounted in the target area 704 using one or more of Velcro straps, cable ties, hooks, clips, etc. The target 712 is a baseball target, a softball target, a golf target, a football target, a soccer target, and/or a Lacrosse target. In an embodiment, the attachable sport specific target 712 has at least one opening at a desired location (e.g., at one or more corners of the strike zone) for receiving the sports ball (e.g., baseball or softball).

FIG. 22 is a front view diagram of another example embodiment of a target end of a sports practice apparatus that includes a target 714 integrated into the target end 704. For example, the integrated target 714 is stitching in the netting of the target area to form a strike zone (or other target shape). In another example, the integrated target 714 is painted on the netting of the target area to form a strike zone (or other target shape). In yet another example, the integrated target 714 is extra twine of the netting of the target area to form a strike zone (or other target shape).

FIGS. 23A and 23B are front and side view diagrams of another example embodiment of a sports practice apparatus 700 that is mounted in an existing batting cage 720. To mount the sports practice apparatus 700 in the existing batting cage 720, the mounting apparatus 706 includes receiving end clips 722 and target end clips 724. The receiving end clips 722 are couple to first and second points of the receiving end and are used to directly coupled to the batting cage 720 or indirectly couple to the batting cage via cables. When the outer dimensions of the receiving end 708 of the tunneling section 702 is comparable to the inner dimensions of the batting cage 702, then the receiving end clips are directly coupled to the batting cage 702. When the outer dimensions of the receiving end 708 of the tunneling section 702 is less than the inner dimensions of the batting cage 702, then the receiving end clips are indirectly coupled to the batting cage 702 via one or more cables.

The target end clips 724 are couple to first and second points of the target end of the tunneling section and are used to directly coupled to the batting cage 720 or indirectly couple to the batting cage via cables. When the target end 710 of the tunneling section 702 is proximal to a back panel of the batting cage, then the target end clips 724 are directly coupled to the batting cage 702. When the target end 710 of the tunneling section 702 is not proximal to a back panel of the batting cage (e.g., target end is 6 or more inches away from the back panel of the batting cage), then the target end clips 724 are indirectly coupled to the batting cage 702 via one or more cables. FIGS. 24A and 24B are front and top view diagrams of another example embodiment of a sports practice apparatus 700-2 that includes two tunneling sections 702 and 702-1 and two target areas 704 and 704-1. The target areas 704 and 704-1 may be for the same sport or different sports. For example, both target areas 704 and 704-1 are used for soccer kick practice. As another example, the first target area 704 is for baseball and the second target area 704-1 is for golf.

In this embodiment, the first tunneling section 702 is constructed in a similar manner as the tunneling section 702 of FIGS. 13A-13C. The second tunneling section 702-1 is constructed in a similar manner as the tunneling section 702-1 of FIGS. 18A-18C.

FIGS. 25A and 25B are front and top view diagrams of another example embodiment of a sports practice apparatus 700-3 that includes two tunneling sections 702-2 and 702-3, a dividing net 730, and two target areas 704 and 704-1. The target areas 704 and 704-1 may be for the same sport or different sports.

In this embodiment, the first tunneling section 702-2 narrows from the left and from the top in a downward direction to the target area 704. The second tunneling section 702-3 narrows from the right and from the bottom in an upward direction to the target area 704-1. The dividing net 730 (i.e., a third tunneling section) separates the two target areas such that the sports ball set into motion in the first tunneling section 702-2 associated with the target area 704 is prevented from traveling to the target area 704-1.

FIGS. 26A and 26B are front and top view diagrams of another example embodiment of a sports practice apparatus 700-3 that includes two tunneling sections 702-3 and 702-4 and two target areas 704-1. The target areas 704-1 may be for the same sport or different sports.

In this embodiment, the first tunneling section 702-3 narrows from the right and from the bottom in an upward direction to the target area 704-1. The second tunneling section 702-4 narrows from the left and from the bottom in an upward direction to the target area 704-1.

FIGS. 27A and 27B are front and top view diagrams of an example embodiment of an adjustable sports practice apparatus 700-4 that includes the tunneling section 702, the target area 704, and adjustable mounting apparatus 740. The tunneling section 702 and the target area 704 are implement in a manner as previously discussed.

The adjusting mechanism (or adjustable mounting apparatus) 74 functions to adjust the narrowing of the tunneling section. For example, and as shown in the FIG. 27A, the adjustable mounting apparatus 740 is in a first position such that the target area 704 is in a first position. Continuing with the example, and as shown in FIG. 27B, the adjustable mounting apparatus 740 is in a second position such that the target area 704 is in a second position.

The adjustable mounting apparatus 740 includes one or more of tie loops, pulleys, hooks, clips, ratchet mechanism to adjust the positioning the target area and the narrowing of the tunneling section. The adjustable mounting apparatus 740 may further include similar mechanisms to horizontally change the position of the target area. As such, the target area and the narrowing of the tunneling section can be adjusted horizontally and/or vertically.

As may be used herein, the terms "substantially" and "approximately" provides an industry-accepted tolerance for its corresponding term and/or relativity between items. Such an industry-accepted tolerance ranges from less than one percent to fifty percent and corresponds to, but is not limited to, component values, integrated circuit process variations, temperature variations, rise and fall times, and/or thermal noise. Such relativity between items ranges from a difference of a few percent to magnitude differences. As may also be used herein, the term(s) "configured to", "operably coupled to", "coupled to", and/or "coupling" includes direct coupling between items and/or indirect coupling between items via an intervening item (e.g., an item includes, but is not limited to, a component, an element, a circuit, and/or a module) where, for an example of indirect coupling, the intervening item does not modify the information of a signal but may adjust its current level, voltage level, and/or power level. As may further be used herein, inferred coupling (i.e., where one element is coupled to another element by inference) includes direct and indirect coupling between two items in the same manner as "coupled to". As may even further be used herein, the term "configured to", "operable to", "coupled to", or "operably coupled to" indicates that an item includes one or more of power connections, input(s), output(s), etc., to perform, when activated, one or more its corresponding functions and may further include inferred coupling to one or more other items. As may still further be used herein, the term "associated with", includes direct and/or indirect coupling of separate items and/or one item being embedded within another item.

One or more embodiments have been described above with the aid of method steps illustrating the performance of specified functions and relationships thereof. The boundaries and sequence of these functional building blocks and method steps have been arbitrarily defined herein for convenience of description. Alternate boundaries and sequences can be defined so long as the specified functions and relationships are appropriately performed. Any such alternate boundaries or sequences are thus within the scope and spirit of the claims. Further, the boundaries of these functional building blocks have been arbitrarily defined for convenience of description. Alternate boundaries could be defined as long as the certain significant functions are appropriately performed. Similarly, flow diagram blocks may also have been arbitrarily defined herein to illustrate certain significant functionality.

To the extent used, the flow diagram block boundaries and sequence could have been defined otherwise and still perform the certain significant functionality. Such alternate definitions of both functional building blocks and flow diagram blocks and sequences are thus within the scope and spirit of the claims. One of average skill in the art will also recognize that the functional building blocks, and other illustrative blocks, modules and components herein, can be implemented as illustrated or by discrete components, application specific integrated circuits, processors executing appropriate software and the like or any combination thereof.

The one or more embodiments are used herein to illustrate one or more aspects, one or more features, one or more concepts, and/or one or more examples. A physical embodiment of an apparatus, an article of manufacture, a machine, and/or of a process may include one or more of the aspects, features, concepts, examples, etc. described with reference to one or more of the embodiments discussed herein. Further, from figure to figure, the embodiments may incorporate the same or similarly named functions, steps, modules, etc. that may use the same or different reference numbers and, as such, the functions, steps, modules, etc. may be the same or similar functions, steps, modules, etc. or different ones.

While particular combinations of various functions and features of the one or more embodiments have been expressly described herein, other combinations of these features and functions are likewise possible. The present disclosure is not limited by the particular examples disclosed herein and expressly incorporates these other combinations.

What is claimed is:

1. A sports practice apparatus comprises:

two target areas;

a plurality of tunneling sections, wherein a first tunneling section of the plurality of tunneling sections is operably associated with a first target area of the two target areas and a second tunneling section of the plurality of tunneling sections is operably associated with a second target area of the two target areas, wherein the first and second tunneling sections each have a receiving end and a target end, wherein one or more of the first and second tunneling sections narrow from the receiving end towards the target end, wherein the narrowing of one or more tunneling sections follows a trajectory that conforms to a desired trajectory of a sports ball set into motion, wherein a dividing net operably separates the two target areas such that the sports ball set into motion in a first respective tunneling section associated with a first respective target area of the two target areas is prevented from traveling to an opposing target area of the two target areas, and wherein the first tunneling section is constructed of a material that prevents the sports ball from exiting the first tunneling section other than at the target end; and mounting apparatus coupled to the one or more tunneling sections for setup of the sports practice apparatus.

2. The sports practice apparatus of claim 1, wherein the first tunneling section comprises:

a first side panel having a first polygon shape;

a second side panel having a second polygon shape, wherein the second polygon shape is complimentary of the first polygon shape; and a top panel attached to the first and second side panels, wherein the top panel has a third polygon shape.

3. The sports practice apparatus of claim 1, wherein the first tunneling section comprises:

a first side panel having a first polygon shape;

a second side panel having a second polygon shape, wherein the second polygon shape is complimentary of the first polygon shape;

a top panel attached to the first and second side panels, wherein the top panel has a third polygon shape; and a bottom panel attached to at least one of the first and second side panels, wherein the bottom panel has a fourth polygon shape, wherein the fourth polygon shape is complimentary to the third polygon shape.

4. The sports practice apparatus of claim 1, wherein the first target area comprises:

an attachable sport specific target having at least one opening at a location for receiving the sports ball, wherein the attachable sport specific target is removably attached to the target end of the first tunneling section.

5. The sports practice apparatus of claim 1, wherein the first target area comprises:

a target integrated into the target end of the first tunneling section.

6. The sports practice apparatus of claim 1, wherein the target end comprises:

from the receiving end's perspective, a substantially triangular shape.

7. The sports practice apparatus of claim 1, wherein the target end comprises one of:

from the receiving end's perspective, a substantially rectangular shape; and from the receiving end's perspective, a substantially linear shape.

8. The sports practice apparatus of claim 1, wherein the mounting apparatus comprises:

a target end tie loop coupled to the target end of the first tunneling section;

a first receiving end tie loop coupled to a first point of the receiving end of the first tunneling section;

a second receiving end tie loop coupled to a second point of the receiving end of the first tunneling section;

a first suspension cable coupled to the target end tie loop;

a second suspension cable coupled to the first receiving end tie loop; and a third suspension cable coupled to the second receiving end tie loop, wherein the first, second, and third suspension cables are for securing to three support structures for supporting the sports practice apparatus.

9. The sports practice apparatus of claim 1, wherein the mounting apparatus comprises:

a first receiving end clip coupled to a first point of the receiving end of the first tunneling section;

a second receiving end clip coupled to a second point of the receiving end of the first tunneling section;

a first target end clip coupled to a first point of the target end of the first tunneling section; and a second target end clip coupled to a second point of the target end of the first tunneling section, wherein the first and second receiving clips and the first and second target end clips are for clipping the sports practice apparatus into an existing batting cage.

10. The sports practice apparatus of claim 1 further comprises:

a level section coupled to a lower edge of the first target area and coupled to the first tunneling section.

11. The sports practice apparatus of claim 1 further comprises:

the first tunneling section following a first trajectory and the second tunneling section following a second trajectory, wherein the first and second target areas are for a same sport.

12. The sports practice apparatus of claim 1 further comprises:

the first tunneling section following a first trajectory and the second tunneling section following a second trajectory, wherein the first target area is for a first sport and the second target area is for a second sport.

13. The sports practice apparatus of claim 1, wherein the first tunneling section comprises:

an entry section at target end for allowing retrieval of the sports ball.

14. The sports practice apparatus of claim 1, wherein the material comprises one or more of:

a mesh netting having an "x" inch spacing;

cloth;

vinyl;

canvas; and plastic.

15. The sports practice apparatus of claim 1 further comprises:

the first tunneling section has a length, for baseball, that is less than distance between a mound and home plate.

16. The sports practice apparatus of claim 1, wherein the first target area comprises one of:

a baseball target;

a softball target;

a golf target;

a football target;

a soccer target; and a Lacrosse target.

17. The sports practice apparatus of claim 1 further comprises:

the target end having perimeter dimensions substantially the same or larger than perimeter dimensions of the first target area.

18. The sports practice apparatus of claim 1, wherein the first tunneling section comprises:

an adjusting mechanism to adjust the narrowing of the first tunneling section, such that the narrowing of the first tunneling section follows a different trajectory that conforms to a different desired trajectory of the sports ball set into motion during practice.

* * * * *